US012735157B2

(12) United States Patent
Wood et al.

(10) Patent No.: US 12,735,157 B2
(45) Date of Patent: Sep. 15, 2026

(54) SUBMERSIBLE ROBOT SYSTEM AND METHODS OF EMPLOYING SAME

(71) Applicants: Fleet Robotics, Inc., Somerville, MA (US); President and Fellows of Harvard College, Cambridge, MA (US)

(72) Inventors: Robert J. Wood, Allston, MA (US); Sidney McLaurin, Allston, MA (US); Michael Austin Bell, Allston, MA (US); Christian Theriault, Allston, MA (US); Satchel Sieniewicz, Allston, MA (US)

(73) Assignees: FLEET ROBOTICS, INC., Somerville, MA (US); PRESIDENT AND FELLOWS OF HARVARD COLLEGE, Cambridge, MA (US)

( * ) Notice: Subject to any disclaimer, the term of this patent is extended or adjusted under 35 U.S.C. 154(b) by 322 days.

(21) Appl. No.: 18/400,212

(22) Filed: Dec. 29, 2023

(65) Prior Publication Data

US 2024/0217634 A1 Jul. 4, 2024

Related U.S. Application Data

(60) Provisional application No. 63/435,957, filed on Dec. 29, 2022.

(51) Int. Cl.
*B63G 8/00* (2006.01)
*B63G 8/38* (2006.01)

(52) U.S. Cl.
CPC ..... *B63G 8/001* (2013.01); *B63G 8/38* (2013.01); *B63G 2008/004* (2013.01)

(58) Field of Classification Search
CPC .... B63G 8/001; B63G 8/38; B63G 2008/004; B63B 59/06; B63B 59/08
See application file for complete search history.

(56) References Cited

U.S. PATENT DOCUMENTS 5,947,051 A 9/1999 Geiger
2010/0131098 A1 5/2010 Rooney et al.
(Continued)

FOREIGN PATENT DOCUMENTS

EP 3838736 A1 6/2021
WO 2014072556 A1 5/2014
WO WO-2019191836 A1 * 10/2019 ..... G10K 11/006

OTHER PUBLICATIONS

International Search Report and Written Opinion for International Patent Application No. PCT/US2023/086388, mailed on Jun. 11, 2024, 11 pages.

*Primary Examiner* — Stephen P Avila
(74) *Attorney, Agent, or Firm* — Brian J. Colandreo; Jeffrey T. Placker; Holland & Knight LLP

(57) ABSTRACT

In a first aspect, embodiments described herein relate to a submersible robot system for inspecting and/or grooming objects (e.g., naval vessels) in a marine environment. In some embodiments, the robot system includes a housing; a plurality of adhesion engines disposed within the housing; an illumination device; and an imaging device. In some applications, each adhesion engine includes a plurality of adhesion devices structured and arranged to secure the system to the object; a magnetic switch motor for switching on and off the adhesion devices; at least one grooming element; and a body rotation motor for moving the grooming element across a surface of the object.

20 Claims, 20 Drawing Sheets

(56) References Cited

U.S. PATENT DOCUMENTS

| | | | | |
|---|---|---|---|---|
| 2012/0006352 | A1 | 1/2012 | Holappa et al. | |
| 2014/0076223 | A1 | 3/2014 | Smith | |
| 2014/0081504 | A1* | 3/2014 | Smith | B63B 17/00<br>114/221 R |
| 2017/0081000 | A1* | 3/2017 | Cioanta | B08B 3/024 |

* cited by examiner

| Sensor | Robot Movements | Adhesion Verification | Localization | Obstacle Detection | Simplistic Navigation | Advanced Navigation | Inspection & Mapping |
|---|---|---|---|---|---|---|---|
| Motor Encoders | X | | X | X | X | X | X |
| Motor Current Sensing | | X | | X | | | X |
| Adhesion engine angle sensors | | X | | X | X | X | X |
| Magnetometer | | X | | X | | | |
| IMU | | | X | X | X | X | |
| Depth Sensor | | | X | | X | X | |
| Distance Sensor | | | | | X | X | X |
| Ultrasound / Eddy current | | | X | | | X | X |
| Vision System (Camera) | | | X | | | X | X |
| Optical Flow Sensor | | | X | | | X | |
| Paint thickness | | | | | | | X |

FIG. 9

| State | | Fixed Adhesion Engine (current sensing) | | Moving Adhesion Engine (current sensing) | | Task case to differentiate |
|---|---|---|---|---|---|---|
| Water velocity | Surface roughness | Mag Vx Mean | Sym Mean | Mag Vx Mean | Sym Mean | |
| Low | Low | - | Nominal | - | Nominal | - |
| Low | High | - | Above Nominal | - | Above Nominal | If a 360 deg rotation of the moving adhesion engine around the fixed adhesion engine has similar current values throughout the rotation, then it's measuring surface roughness. |
| High | Low | - | Above Nominal | - | Nominal | - |
| High | High | - | Above Nominal | - | Above Nominal | If a 360 deg rotation of the moving adhesion engine around the fixed adhesion engine has varying current values, then likely it's from water velocity as that will have roughly constant vector pushing against the robot. |

FIG. 10

SUBMERSIBLE ROBOT SYSTEM AND METHODS OF EMPLOYING SAME

CROSS-REFERENCE TO RELATED APPLICATIONS

This application claims priority to, and the benefit of, U.S. Provisional App. No. 63/435,957, filed Dec. 29, 2022, the entirety of which is incorporated herein by reference.

TECHNICAL FIELD

The present disclosure relates generally to a robot system and methods for inspecting and/or grooming the surfaces of objects in a environment. More particularly, the present disclosure is directed at a robot system operating in denied environment such as under-water and methods of employing the same.

BACKGROUND

Biofouling refers to the fouling of submerged structures (e.g., ship's hulls) and involves the degradation of the primary purpose of underwater surfaces due to the accumulation of matter and organisms, such as, for example, algae, plants, barnacles, microorganisms, or the like on the underwater surfaces. Problematically, especially when dealing with the submerged portions of marine and naval vessels, the accumulation of such matter and organisms creates a drag on the vessel's propulsion system. More particularly, the greater the fouling, the greater the drag force and, correspondingly, the greater the portion of the propulsion force that must be used just to overcome the additional drag. The additional force required has a direct impact on the fuel consumption, wear and tear, maintenance, and monitoring of a plurality of mechanical sub-systems which might not operate at their optimal levels. Additional consequences of the greater fuel consumptions include increased pollution production and associated green-house-gas emission.

Equally as problematic are the growing number of regulatory restrictions addressing the transportation of invasive species into waterways and bodies of water. More particularly, in some instances, marine and naval vessels having accumulated excessive matter and organisms, (e.g., algae, plants, barnacles, microorganisms, or the like) on the underwater surfaces may be denied access to a port of entry and/or may be fined due to the foreign nature of the said organic matter and their possible consequence on the local ecosystems

SUMMARY OF THE DISCLOSURE

In a first aspect, embodiments described herein relate to a submersible robot system for inspecting and/or grooming objects (e.g., naval vessels) in a marine environment. In some embodiments, the robot system includes a housing; a plurality of adhesion engines disposed within the housing; an illumination device; and an imaging device. In some applications, each adhesion engine includes a plurality of adhesion devices structured and arranged to secure the system to the object; a magnetic switch motor for switching on and off the adhesion devices; at least one grooming element; and a body rotation motor for moving the grooming element across a surface of the object.

In a second aspect, embodiments described herein relate to a method for inspecting and/or grooming objects (e.g., naval vessels) in a marine environment. In some embodiments, the method includes the steps of providing a robot system for grooming a surface of the object and navigating the robot system to groom the object. In some embodiments, the robot system includes a housing; a plurality of adhesion engines disposed within the housing; an illumination device; and an imaging device. In some applications, each adhesion engine includes a plurality of adhesion devices structured and arranged to secure the system to the object; a magnetic switch motor for switching on and off the adhesion devices; at least one grooming element; and a body rotation motor for moving the grooming element across a surface of the object.

BRIEF DESCRIPTION OF THE DRAWINGS

The present disclosure is more fully appreciated in connection with the following detailed embodiment description taken in conjunction with the accompanying drawings, in which:

FIG. 9 shows a summary of a sensing system hierarchy in accordance with some embodiments of the disclosure;

FIG. 10 shows a summary of current sensing associated with various water velocities and surface roughness, in accordance with some embodiments of the disclosure;

DETAILED DESCRIPTION

Figure 1:
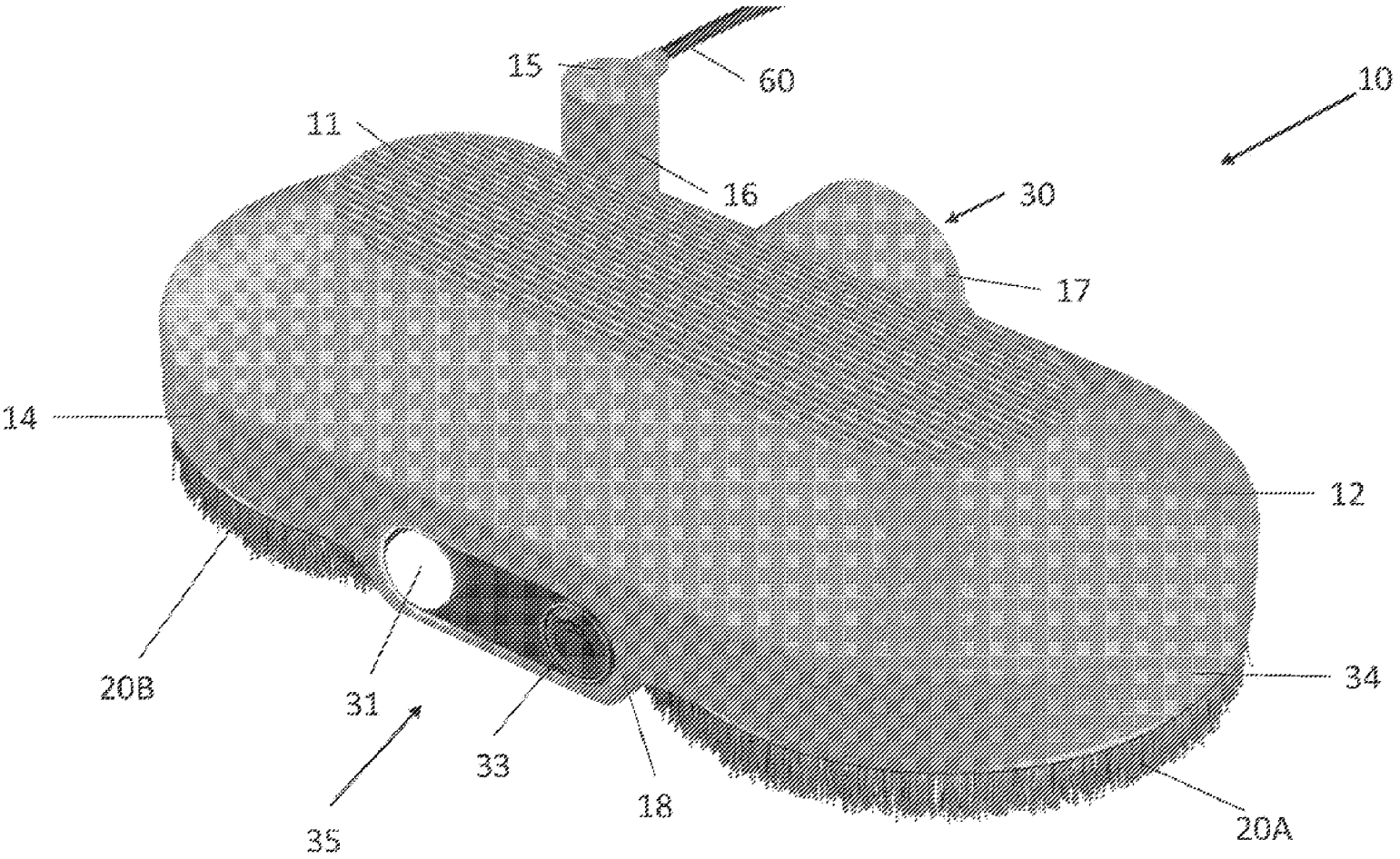
FIG. 1 shows a top perspective view of the front of a system for inspecting and/or grooming objects in a marine environment, in accordance with some embodiments of the disclosure.

Aspects of the present disclosure can be used to reduce the degree of biofouling (e.g., on a ship's hull or the like) by providing robotic systems and methods for inspecting the condition of the surface of the ship's hull, for removing the source of the potential biofouling from submerged surfaces, and for maintaining those surfaces clean. In an embodiment, (e.g., fossil) fuel consumption data before and after removal operations may be used to demonstrate a diminution of carbon emissions for which carbon credits may be generated. For example, the Carbon Intensity Indicator (CII) or a similar reliable and verifiable measure, may be used to gauge how efficiently a marine or naval vessel transports its cargo in terms of grams of carbon dioxide emitted per cargo-carrying capacity and nautical mile. The differences in the CII, before and after cleaning or grooming operation, may be used to provide a number and value to the carbon credits in terms of the amount of fossil fuel saved and carbon dioxide emitted.

In some embodiments, systems and methods provided herein for inspecting and/or grooming the surfaces of objects (e.g., naval vessels) in a (e.g., marine) environment can be used to overcome several obstacles of modern inspecting and/or grooming operations of marine vessels. For instance, modern inspecting/grooming operations may take place within a port facility (i.e., at portside) at which the size of the inspecting/grooming system can be more effectively handled and supported by land-based auxiliary system, as well as divers, and at which the velocity of the water has a reduced or limited effect on the performance of the cleaning cart system. Portside inspecting/grooming operations may, however, be limited. For example, environmental regulations may either not permit or limit the extent or the nature of the inspecting/grooming operations within a port. Conducting the inspecting/grooming operations within a port may also be affected by the availability of a mooring location, as well as divers. Furthermore, when permitted, low visibility due, for example, to murky water within the port may affect the inspecting/grooming operations. Finally, portside inspecting/grooming systems are typically relatively expensive and lack flexibility in their implementation. Indeed, portside inspecting/grooming systems tend to be bulky, requiring extensive mooring space and auxiliary equipment.

The present disclosure provides for a more flexible system that is (i) more economical and (ii) smaller in size; that may be (iii) employed in the open waters, outside of a port, while the (e.g., marine or naval) vessel is anchored or underway, where the inspecting/grooming system and the object to be cleaned may be subject to more significant water flow; and that (iv) may be performed without using divers is desirable. The present system, when used to perform inspecting/grooming operations outside of a port, may be applied when the object (e.g., a naval vessel) is awaiting entrance into the port, which may more effectively use a waiting time.

Although the present disclosure will be described for application in a marine environment and for an object made of a ferrous metal, the environment and composition of the object are used for illustrative purposes only. Those skilled in the art can appreciate that the inspecting and grooming robot systems described hereinbelow are not limited to applications in a marine environment and/or to objects made of a ferrous metal.

Submersible, Self-Propelled System for Inspecting/Grooming Objects

Referring now to FIG. 1, submersible self-propelled system 10 is illustrated. Although those skilled in the art can appreciate that there are a myriad of objects, such as but not limited to industrial assets, for which the system 10 may be used, for the purposes of brevity and illustration rather than limitation, the object will be described as a marine or naval vessel and, more specifically, the ferrous hull of a marine or naval vessel (hereinafter "ship's hull"). Moreover, although embodiments will be described in which the object is submerged in ocean water and subject to water currents, those skilled in the art can appreciate that the system 10 may be used in other fluids such as, for the purpose of illustration rather than limitation: fresh water, lubrication fluids, dielectric fluids, fossil fuels, and the like, and subject to a variety of fluid conditions. Furthermore, although embodiments will be described in conjunction with applications in which the ship's hull is made from a ferrous metal, those skilled in the art can appreciate that the teachings of this disclosure may also be applied to industrial assets made of non-ferrous materials, as well as to surfaces having a specialized coating.

System 10 may be sized and dimensioned to reduce a weight of the system 10 to a few pounds (or kilograms), which may reduce manufacturing, operational, maintenance, replacement, and/or other costs of system 10. System 10 may be deployed by a single user, in some embodiments. In some embodiments, plurality of systems 10 may be used, such as, but not limited to, in a swarm. Systems 10 in a swarm of systems 10 may be individually and/or collectively controlled, in some embodiments. For instance and without limitation, a plurality of systems 10 may operate in a swarm intelligence, such as, but not limited to, particle swarm optimization, ant colony optimization, bee swarm optimization, and the like. A swarm of systems 10 may operate to generate mappings of a ship's hull, work together to clean a ship's hull, and the like. Each system 10 in a swarm of systems 10 may have an awareness of each other system 10 in the swarm, surroundings of an environment, and the like. In some embodiments, a swarm of systems 10 may have autonomy, such as being able to operate solely without requiring commands from other swarm members. A system 10 in a swarm of systems 10 may have a solidarity aspect, for instance by autonomously looking for a new task once an initial task is completed, such as cleaning an area, mapping a portion of ship's hull, gathering data, and the like. A swarm of systems 10 may be expandable, for instance by traversing away from a center of mass of systems 10 in the swarm. In some embodiments, a swarm of systems 10 may be resilient, for instance when one or more members of the swarm are removed, the swarm may adjust operation to compensate for the removal.

System 10 may include a plurality of sensors. One or more sensors of a plurality of sensors of system 10 may include, but are not limited to, sensing devices (or sensors) including, imaging devices, cameras, inertial measurement units (IMUs), depth and/or pressure sensors, temperature sensors, ultrasound and/or ultrasonic devices, turbidity sensors, hydrophones, global position devices, chemical sensors, scanning SQUID microscopy, corrosion sensors, paint and/or coating thickness sensors, and/or other sensors. A plurality of sensors of system 10 may be structured and arranged to provide data to a computing device of system 10 and/or one or more external computing devices, such as, but not limited to, smartphones, laptops, desktops, tablets, servers, and the like. Data of a plurality of sensors in the form of either relative or absolute in magnitude of system 10 may include, but is not limited to, image data, depth data, pressure data, turbidity data, GPS data, chemical data, and/or other forms of data that may be generated by any of the sensors described above and be relayed to the user through one or more external computing device. Data generated by one or more sensors may be used by system 10 to perform various tasks such as, but not limited to, (i) remote inspection and location mapping, (ii) clean (e.g., large) industrial surfaces, (iii) perform preliminary troubleshooting, (iv) perform maintenance, and/or other tasks. In some embodiments, data and information generated by the plurality of sensors may be used to evaluate one or more of an integrity, structure, surface quality, and other elements related to a surface being inspected and or cleaned, a surface being, but not limited to a ship's hull. In some embodiment, a representation of acquired data may be provided to a user through a 4 dimensional (x, y, z, and time) representation of a surface where system 10 has been deployed. In some embodiments, data provided through a 4 dimensional representation of surface may include coordinates, temporal elements, sensor data, and the like. For instance and without limitation, sensor data may be mapped to coordinates of a 4 dimensional representation of surface. A machine learning model, such as described below with reference to FIG. 17, may reconstruct and/or make future projections of relative and/or absolute magnitude of any variables described throughout this disclosure based on a 4 dimensional representation of a surface. In some embodiments, a machine learning model may generate one or more representations of a surface through two or more variables.

In some embodiments, system 10 may include sensors and communication equipment that may enable a user and/or system 10 to characterize a surface of a ship's hull, even while the ship's hull is in motion and/or with a steady fluid stream. For instance, a computing device of system 10 and/or a computing device in communication with system 10 may be configured to characterize a geometry, thickness, surface area, and/or other characteristics of a ship's hull. In some embodiments, once a surface of a ship's hull has been characterized, system 10 may be configured to generate and/or calculate absolute and/or relative locations of itself in relation to a ship's hull. An absolute location may include a GPS location, cartesian and/or polar coordinates of a location of a hull, and/or other locations. Relative locations may include distances, heights, and the like, in relation to one or more features of a hull, such as, but not limited to, ribs, weld lines, and the like. As a non-limiting example, a relative location may include a distance of about 10 feet from a first rib of a ship's hull. One or more sensors of system 10 may generate location data. Location data may include, but is not limited to, GPS coordinates, depths, heights, altitudes, proximities, and the like. Location data may enable the system 10 to know a precise location of itself. A precise location may include an absolute or relative location, in some embodiments. A precise location may be a location determination within an error margin of about 0.1%, in some embodiments. Knowing a precise location of itself may enable system 10 to navigate along a ship's hull in a programmed path. Location data may include a temporal element. A temporal element may include a time of day, seconds, minutes, hours, and the like from reference points, and/or other forms of temporal information. As a non-limiting example, a relative location may include a distance of about 10 feet from a first rib of a ship's hull with a temporal element of 10 minutes from an initial deployment of system 10. A programmed path may include a directional route or other traversal guide that system 10 may follow along a ships' hull. A programmed path may include a linear, non-linear, geometric, and/or other path. In some embodiments, a programmed path may include one or more grid-like patterns. In some embodiments, system 10 may adjust a programmed path based on sensor data, such as, but not limited to, depth data, proximity data, hall effect data, temporal data and the like. Temporal data may include one or more timestamps of one or more operations of system 10, measured periods of time of system 10 performing various tasks, coordinates and/or relative positions of system 10 at various times relative to an initial start point, and the like. Timestamps may include specific points in a timeline of operation of system 10, such as lengths of operations, which may include cleaning, mapping, inspecting, and the like. Timestamps may be relative to an initial start point of one or more operations of system 10. An initial start point may include a deployment of system 10 to a denied environment, such as underwater. In other embodiments, an initial start point may begin when system 10 begins an operation, such as cleaning, traversal, mapping, and the like. In some embodiments, an initial start point may be set by a user. Timestamps may be specific to an absolute location, such as a GPS location, and/or a relative location, such as within a proximity of one or more features of a surface. Features may include, but are not limited to, ribs of a ship's hull, rotors of a ship, valves of a ship, heights of a ship, and/or other features. As a non-limiting example of temporal data, temporal data may include a period of time of cleaning an area of a surface for about 45 minutes, followed by traversing the surface for about 2 minutes followed by a mapping operation for about 10 minutes. Temporal data may be used by a computing device of system 10 and/or a computing device in communication with system 10 to determine a deviance from a programmed path. A deviance from a programmed path may include, but is not limited to, a distance of system 10 from a relative position, a distance of system 10 from an absolute position, a deviance from a relative and/or absolute position of system 10 with respect to a passage of time, and/or other combinations of temporal elements and positions of system 10. For instance, and without limitation, temporal data may be used to determine if system 10 deviated from an ideal programmed path. An ideal programmed path may include absolute and/or relative positions of system 10 with respect to one or more timestamps, such as in seconds, minutes, hours, and/or other measures of time, may include a cleaning efficiency of system 10, a cleaning rate of system 10, and the like. A cleaning efficiency may include a rate of increased cleanliness of a surface of an object per a period of time, such as in minutes, hours, and the like. A cleaning rate may include a surface area covered by system 10 per a period of time. As a non-limiting example, a cleaning efficiency may be 80% efficient relative to an ideal amount of bio fouling removed from a surface per hour. An ideal amount of bio fouling removed may be about 1 kg per hour, without limitation. As another non-limiting example, a cleaning rate may be 10 square meters of a surface per 10 minutes. A comparison of temporal data and/or relative, absolute, or other positions of system 10 to an ideal programmed path may be used to determine a deviance of system 10 from the ideal programmed path and/or to determine a path taken by system 10 during a period of time. As a non-limiting example, system 10 may be programmed with an ideal path to clean a surface, such as a ship's hull, for a period of time of 30 minutes. System 10 may clean the surface of the ship's hull for only 19 minutes, deviating from the time period for cleaning the ship's hull.

System 10 may operate locally without communication to external computing devices. Continuing this example, once system 10 finishes a cleaning operation of a surface, a comparison of relative and/or absolute locations of system 10 and temporal data associated with these locations may be made to parameters of an ideal programmed path, which may determine a ground-truth of a path taken by system 10. A ground truth of a path taken by system 10 may be an actual path taken by system 10 which may differ from an ideal path taken by system 10. In some embodiments, a ground truth may be determined by obtaining data from system 10 after a cleaning operation and comparing the data of an actual path taken by system 10 to one or more parameters of an ideal path through a computing device and/or a machine learning model. A comparison of a ground-truth of system 10 with an ideal path of system 10 may be used to determine an actual cleaning operation of system 10, if additional cleaning, surface mapping, and/or other work may be needed, and/or other determinations. In embodiments of a swarm configuration, upon determination additional cleaning and/or mapping may be needed, one or more swarm members may be configured to finish these tasks uncompleted by a deviant swarm member. A comparison of a ground-truth of system 10 with an ideal path of system 10 may include a comparison of one or more threshold values, such as a deviance of an absolute and/or relative location by distance in millimeters, meters, and the like, a deviance in cleaning efficiency, a deviance in cleaning rate, and/or other parameters. A deviance of an absolute and/or relative location may include a deviance in temporal data, such as seconds, minutes, hours, and the like and one or more relative and/or absolute locations associated with the temporal data.

In some embodiments, system 10 may be configured to determine deviances, comparisons of ideal paths with actual paths taken, and the like, on-board or via communication with one or more external computing devices. System 10 may self-adjust based on one or more thresholds of deviance being met, such as distances from an absolute and/or relative location with respect to temporal data, cleaning operation completeness, surface mapping completeness, and/or other parameters. System 10 may be configured to optimize a cleaning operation locally or remote via communication with one or more external computing devices. Optimization may include using one or more machine learning models, objective functions, loss functions, and the like. Optimization may include maximizing increased cleanliness levels of a surface, such as surface areas covered by system 10 while minimizing a total time spent cleaning. For instance, system 10 may prioritize hot spots of bio fouling of surface while minimizing time spent cleaning low areas of bio fouling of the surface.

In some embodiments, system 10 may utilize a path machine learning model to calculate a most efficient path. A path machine learning model may be trained on training data correlating sensor data and/or programmed paths to one or more adjusted paths. Training data may be received through user input, external computing devices, and/or previous iterations of processing. In some embodiments, system 10 may train and/or deploy a path machine learning model locally. In other embodiments, a path machine learning model may be trained and/or deployed and outputs of the path machine learning model may be communicated to system 10. A path machine learning model may account for depths, hull movement, debris, hull cleanliness, adhesion force, and/or other parameters that may affect a path of system 10. A path machine learning model may be used to determine deviance, ideal programmed paths, ground-truths, optimizations of cleaning operations, and/or any other determination described above, without limitation. For instance, a path machine learning model may generate a model of an actual path taken by system 10 compared to an ideal path of system 10. A path machine learning model may generate one or more thresholds of deviance. In other embodiments, a path machine learning model may receive thresholds of deviance from user input. Those skilled in the art, upon reading this disclosure, can appreciate that as the system 10 becomes more precisely localized, the efficiency of cleaning increases since the system 10 does not have to duplicate paths to ensure coverage of 100% of the surface area of the ship's hull. In some embodiments, a combination of a path machine learning model and on-board sensors of system 10 may be combined. For example, and without limitation, those skilled in the art, upon reading this disclosure, will recognize that not all areas of a surface will accumulate biofouling or other debris at the same rate and this information can be used to inform the path of system 10. A path machine learning model may determine a cleaning rate and/or cleaning path of system 10 based on a cleanliness level of a surface, such as a ship's hull. Cleanliness levels may be determined by image sensor data and/or other data received from one or more sensors of system 10, as described below in further detail. A path machine learning model or other process may determine a cleaning rate of system 10. A cleaning rate may include a period of time system 10 may spend cleaning an area of a surface. A cleaning rate may be specific to one or more parts of a surface. In some embodiments, a path machine learning model may determine a heat spot or highest culmination of bio fouling of a surface. A heat spot may be used to determine a cleaning path of system 10 by a path machine learning model. A path machine learning model may determine one or more cleaning operations of system 10, such as one or more paths, power outputs of cleaning devices such as brushes described below, and/or other parameters. For instance and without limitation, a cleaning path machine learning model may determine a specific spot of a surface may require multiple passes from system 10 with varying rotations per minute (RPM) of one or more brushes of system 10.

Application and use of the system 10 in a marine environment in which the system 10 operates while submerged presents some unique design elements. For example, once submerged, a slightly positive buoyancy of the system 10 coupled with the effect of forces underwater, as well as the velocity of water, may tend to push the system 10 up and away from the surface of the ship's hull, deleteriously affecting the ability of the system 10 to inspect and/or groom the ship's hull.

In some embodiments, to counteract a tendency of the system 10 to push up and away from a ship's hull, the system 10 may be adapted to utilize an adhesion system to adhere to a myriad of surfaces, including (e.g., planar, convex, and concave) surfaces made of ferrous metals. Although embodiments are described for an application with ferrous metals, those skilled in the art, upon reading this disclosure, can appreciate that the teachings of the system can be modified to provide adhesion using negative pressure (i.e., suction). Furthermore, the system 10 may be configured to utilize a path planning methodology that controls the speed, location, and operating path of the system 10 on the ship's hull. A path planning methodology may taking into account a magnitude of one or more external forces exerted on system 10 during its operation, a location of system 10 relative to a ship's hull, obstructions in a path of system 10, effectiveness of cleaning a ship's hull and the like. For instance, a horizontal orientation of system 10 relative to a ship's hull may save a most amount of energy of system 10 but may reduce a downward pressure exerted by water flow as the water flows above system 10. Taking the orientation of system 10 and exerted pressure of system 10 into consideration, a path may be planned to modify an alignment of system 10 to increase or decrease an adhesion level of system 10 to a ship's hull which may increase or decrease an energy consumption of system 10. A path planning methodology may include utilizing one or more machine learning models, such as any machine learning model as described throughout this disclosure, without limitation.

A method of locomotion of system 10 across a ship's hull may rely on constantly and/or continuously providing a variable level of adhesion of the system 10 to the ship's hull, which may be provided regardless of the conditions, including the planarity, convexity, and/or concavity of the surface of the ship's hull or any environmental effects, such as the velocity of water currents impacting the ship's hull and the system 10. A level of adhesion may be commensurate with a necessary force to hold the system 10 to the ship's hull while also providing enough adhesive force so that the brushes 24 of the plurality of grooming elements 20A, 20B are capable of removing unwanted debris and matter from the surface of the ship's hull. System 10 may be configured to utilize an adhesion machine learning model or other neural network. An adhesion machine learning model may be trained with training data correlating hull conditions and/or environmental affects to levels of adhesive force. Training data may be received through user input, external computing devices, and/or previous iterations of processing. An adhesion machine learning model may be configured to input current adhesion levels, environmental effects, and/or hull conditions and output one or more levels of adhesion. In some embodiments, an adhesion machine learning model may be trained and/or deployed locally. In other embodiments, an adhesion machine learning model may be trained and/or deployed on an external computing device and outputs of the adhesion machine learning model may be provided to system 10.

In some embodiments, the system 10 is adapted to utilize variable levels of adhesion offered by a plurality of selectively controllable and variably-switched magnets 26. A controller and/or a control application may be adapted to turn or switch on selective magnetic adhesion devices 26, turn or switch off magnetic adhesion devices 26, and/or to control or adjust the strength of the magnetic force of selective magnetic adhesion devices 26. For example, in one embodiment, a controller and/or a control application may be adapted to cause the system 10 to move using at least two switchable points of contact, such as two magnetic adhesion devices 26. A controller and/or a control application may selectively and/or alternatively turn on one or more magnetic adhesion devices 26. In some embodiments, a first magnetic adhesion device 26 may be a first point of contact that, when in an active or turned on state, is securely attached to the ship's hull. A second magnetic adhesion device 26 may be a second point of contact that, while in an inactive or turned off state, may have a low or easily breakable level of adherence to the ship's hull. The system 10 may be capable of being pivoted or rotated about a first point of contact. In some embodiments, by alternatively switching on and off one or more magnetic adhesion devices 26, a "leapfrogging" form of locomotion may be produced. A leapfrogging method may ensure that at least one of the magnetic adhesion devices 26 remains firmly anchored to the ship's hull to prevent the system 10 from falling off of the hull. In some embodiments, high friction rubber pads may be disposed about the magnetic adhesion devices 26, which may help prevent slippage along the surface of an object system 10 may be adhered to. High friction rubber pads may increase the static and dynamic friction of the adhesion engine of system 10.

In some embodiments, system 10 may include a communication device that may be configured to emit one or more signals. Signals may include, but are not limited to, ultrasonic, sonic, infrared, radio, and/or other signals. Communication devices may include ultrasonic transmitters, radio transmitters, infrared transmitters, and the like. Communication devices may help facilitate locating and retrieving the system 10 were it to become dislodged from the ship's hull. In one embodiment, the system 10 may include a signaling device that may generate and emit a signal to, for example and without limitation, an autonomous underwater vehicle (AUV). An AUV may be a submerged, water-based, or aerial vehicle. An AUV may include a retrieving arm to retrieve the lost system 10, in some embodiments.

Referring still to FIG. 1, system 10 includes a plurality of grooming elements 20A, 20B that are adapted to remove debris and/or other obstacles from a surface of the ship's hull. In some embodiments, grooming elements 20A, 20B, may be adapted to remove debris regardless of an orientation of the system 10 and/or ship's hull, surface of the ship's hull, motion of the marine vessel, and/or environmental conditions. A plurality of sensors incorporated into the system 10 may enable a user and/or the system 10 to evaluate the effectiveness of cleaning and grooming operations. For instance and without limitation, imaging devices and/or other sensors may provide information to system 10 about a level of cleanliness of a ship's hull. In some embodiments, a cleaning machine learning model may be used by system 10. A cleaning machine learning model may be trained with training data correlating sensor data to hull cleanliness. Training data may be received through user input, external computing devices, and/or previous iterations of processing. A cleaning machine learning model may be configured to input sensor data and output one or more levels of hull cleanliness, such as, but not limited to, dirty, average, clean, spotless, and the like, and/or levels of force applied by grooming elements 20A, 20B corresponding to the levels of hull cleanliness. As a non-limiting example, a cleaning machine learning model may input sensor data and output a hull cleanliness level of dirty with a corresponding power output or force of grooming elements 20A, 20B of high. A cleaning machine learning model may be trained and/or deployed locally to system 10 and/or may be trained and/or deployed on a remote computing device and outputs of the cleaning machine learning model may be communicated to system 10.

In some embodiments, the system 10 includes a plurality of rotatable brushes 24 for maintaining the ship's hull. Rotatable brushes 24 may be configured to rotate in a clockwise and/or counter-clockwise direction. In some embodiments, system 10 may include two or more rotatable brushes 24. For instance and without limitation, system 10 may include a first rotatable brush 24 on a left side of system 10 and a second rotatable brush 24 on a right side of system 10. In some embodiments, one or more magnetic adhesion devices 26 may be placed within a perimeter of rotatable brushes 24. As a non-limiting example, three magnetic adhesion devices 26 may be placed in a first perimeter of rotatable brush 24 and three magnetic adhesion devices 26 may be placed in a second perimeter of a second rotatable brush 24. In some embodiments, a first rotatable brush 24 may be configured to operate independently from a second rotatable brush 24. As a non-limiting example, a first rotatable brush 24 may rotate in a clockwise direction and a second rotatable brush 24 may rotate in a counter-clockwise direction. In some embodiments, two or more rotatable brushes 24 may be operated simultaneously and/or collectively. Rotatable brushes 24 may be circular, square, and/or other geometric shapes. In some embodiments, rotatable brushes 24 may have a radius of about 5 inches. In other embodiments, rotatable brushes 24 may have a radius of greater than or less than about 5 inches. In some embodiments, the magnetic adhesion elements 26 may be selectively controlled to provide a greater or lesser magnetic force to the surface of the ship's hull which may enable the rotatable brushes 24 to remove debris, marine life, and/or unwanted material. To facilitate matching an appropriate magnetic force to a detected debris, marine life, and/or unwanted material (e.g., biofouling), the imaging device 33 and light-emitting element 31 may be used to detect debris, marine life, and the like. In some embodiments, a computing device of system 10 may be configured to adjust magnetic force applied to a surface of a the ship's hull based on sensor data received from one or more sensors, such as, but not limited to, imaging device 33 and/or other sensors.

In some embodiments, system 10 may include bellows 34. Bellows 34 may be operable of maintaining concave and convex surfaces encountered from stem to stern and/or from port to starboard of the marine vessel. For instance and without limitation, system 10 may have a first bellow 34 on a right side of system 10 and a second below 34 on a left side of system 10. Each bellow 34 may be operable to rotate with respect to a bottom surface of system 10, such as in a clockwise and/or counter-clockwise direction. Each bellow 34 may be controlled independently of one another. An adjustment in an angle of bellows 34 may allow system 10 to traverse various concavities and/or convexities of a hull of a ship. A computing device of system 10 may detect various elements of a surface of a ship's hull and may adjust angles of bellows 34 accordingly.

Advantageously, a stiffness or bristle hardness of the rotatable brushes 24 may be adjusted to be softer or stiffer, depending on the nature and degree of the debris of a ship's hull. In some embodiments, for example and without limitation, when a degree of biofouling is minor, a single rotatable brush 24 may be combined with a wiper. For certain debris, marine life, and/or unwanted material that cannot be removed by the rotatable brushes 24, a specially-designed cleaning attachment may be used instead, in some embodiments. For example, in some applications, the rotatable brushes 24 may be replaced by rotatable cutter blades to remove, for example and without limitation, barnacles and mussels. In other embodiments, the rotatable brushes 24 may be replaced by polishing brushes that can be used to lower a surface friction on the object after completion of a general cleaning. In some embodiments, system 10 may have a combination of rotatable brushes 24, rotatable cutter blades, and/or polishing brushes. One or more of rotatable brushes 24, rotatable cutter blades, and/or polishing brushes may be activated by a computing device of system 10 based on sensor data, such as, but not limited to, image data, adhesion data, and the like.

In some embodiments, system 10 may include a non-fixed body. A non-fixed body may be any body that is capable of non-detrimentally flexing, stretching, contorting, and the like. For instance, system 10 may have a flexile skeletal body. A flexible skeletal body may include one or more interconnected components that may be mechanically operable to rotate, stretch, contort, and the like. In some embodiments, a flexible skeletal body may be linearly, non-linearly, or otherwise shaped. A flexible skeletal body may include a main body with one or more branches that may extend away from the main body. In some embodiments, a flexible skeletal body may be a body where any of a primary or secondary structural element of the body includes joints or other flexible elements with variable stiffness that may be controlled to conform to a surface's geometry thereby enabling system 10 to adhere and operate and conform to non-planar surfaces. In an embodiment, first housing portion 12 and/or second housing portion 14 may include one or more mechanical joints that may allow flexion, rotation, contraction, and the like of one or more components of system 10. A flexible skeletal body of system 10 may allow for one or more degrees of freedom. For instance and without limitation, a flexible skeletal body of system 10 may allow for up to or more than 6 degrees of freedom. Increased degrees of freedom may enable increased sensing of system 10. For instance and without limitation, system 10 may have one or more sensors in communication with one or more joints of a skeletal body that may allow for additional sensing of an environment and/or positioning of system 10. As a non-limiting example, instead of relying on on-board sensors of system 10, one or more parts of a flexible skeletal body may be configured to detect water flow, pressures, magnetic fields, and the like. In some embodiments, one or more parts of a flexible skeletal body may include one or more adhesion devices, such as magnetic adhesion devices 26, that may provide for an adhesion of the flexible skeletal body to one or more parts of a ship's hull. Adhesion devices of a flexible skeletal body may increase locomotion capabilities of system 10, such as by having more degrees of freedom. Increased sensing capabilities of a skeletal body may provide additional and/or more accurate sensor data to one or more machine learning models, such as any machine learning model described throughout this disclosure, without limitation. Sensor data of a flexible skeletal body may be used by one or more machine learning models to improve predictions of, but not limited to, locomotion of system 10, detection of adhesion levels of one or more magnetic adhesion devices 26, mapping generation of a ship's hull, and the like.

With continued reference to FIG. 1, the system 10 may be capable of interacting with one or more assets. Assets may include, but are not limited to, the sea chest, intake and outflow pipes, sacrificial anodes, and the like. System 10 may be capable of interacting with one or more assets using robotic manipulation. Robotic manipulation may include any activation of an element of system 10 as described throughout this disclosure, without limitation. In some embodiments, system 10 may be configured to gather information relevant for maintenance related to the surface of the ship's hull, substrate, or any other aspects of the environment. Relevant information may include any sensor data as described throughout this disclosure, without limitation. Robotic manipulation work may be performed on either a scheduled or ad hoc basis. In some applications, system 10 may utilize an asset machine learning model to predict when assets may require preliminary intervention. Preliminary intervention may include an individual removing or otherwise manipulate an asset. A removal and/or manipulation of an asset may allow system 10 to continued cleaning a ship's hull. An asset machine learning model may be trained with training data correlating sensor data to one or more assets requiring preliminary intervention. Training data may be received through user input, external computing devices, and/or previous iterations of processing. An asset machine learning model may be configured to input sensor data and output an indication of one or more assets needed preliminary intervention. System 10 may train and/or deploy an asset machine learning model locally and/or be in communication with an external computing device that may train and/or deploy the asset machine learning model.

System 10 may be operable to collect data about the surface of the ship's hull to create a temporal mapping of the surface of the ship's hull. A temporal mapping may be a geographical layout of a ship's hull within certain periods of time. Certain periods of time may include, but are not limited to, minutes, hours, days, and the like. In some embodiments, a temporal mapping may be a real time geographical layout of a ship's hull. A temporal mapping, which may be generated through either specific or arbitrary temporal intervals, may enable a user and/or system 10 to track any and all changes in the conditions of the surface of the ship's hull through utilization of precise location and sensor data. This feature may enable a user and/or system 10 to take one or more maintenance actions to prevent further surface, structural, or other degradation of the ship's hull.

In some embodiments, system 10 includes a housing portion. A "housing" as used in this disclosure is a structure that contains components and/or subcomponents of a system or device and is a part of the system or device itself. A housing portion of system 10 may house one or more elements of system 10, as described in further detail below. A housing portion may have a first or upper housing portion 12 and a second or lower housing portion 14. First housing portion 12 may be position oppose second housing portion 14. In some embodiments, first housing portion 12 may be configured to removably mate with second housing portion 14. A mating of first housing portion 12 and second housing portion 14 may provide an interior spacing that may accommodate one or more elements of the system 10. In an illustrative embodiment, the system 10 may be about 12 inches in length, about 6 inches in width, and about 4 inches in height, without limitation. The system 10 may be greater than or less than 12 inches in length, 6 inches in width, and about 4 inches in height, in some embodiments.

The first housing portion 12 may be hydrodynamically designed. For instance and without limitation, the first housing portion 12 may be shaped as a shell or other hydrodynamic shape that may be structured and arranged to allow the system 10 to remain on the surface of the object even during high flow rates. In some embodiments, the first housing portion 12 may have a plurality of indentations and/or grooves that may increase hydrodynamics of system 10. For instance, and without limitation, first housing portion 12 may have a plurality of thin lines parallel to one another and equidistant from each other. System 10 may be structured and arranged to provide a slightly positively buoyancy to enable the system 10 float if dislodged during use. Alternatively, or in addition, the system 10 may include an airbag and gas source disposed within an inner space between first housing portion 12 and second housing portion 14. An airbag and gas, which may be compressed air, may be operable so that should the system 10 become dislodge and start to sink, the gas may inflate the airbag which may cause system 10 to rise to a surface of a body of water. In some embodiments, an airbag system may be deployed upon system 10 reaching a predetermined depth, such as, but not limited to, about 20 meters.

Referring still to FIG. 1, first housing portion 12 and the second housing portion 14 may be configured to mate with each other which may provide an air and/or waterproof seal. An air and/or waterproof seal produced by a mating of first housing portion 12 and second housing portion 14 may prevent seawater, air, and/or other fluids from entering an interior of system 12. Alternatively, or optionally, the first housing portion 12 and the second housing portion 14 may be configured to accommodate a sealing device. A sealing device may include, but is not limited to, a gasket, O-ring, and/or other sealing device. In some embodiments, a sealing device may be disposed within a groove formed in a periphery of one or both of the first housing portion 12 and the second housing portion 14.

Referring still to FIG. 1, in some embodiments, the first housing portion 12 may include a heatsink feature 11. The heatsink feature 11 may be made of a metal or other element that may conduct heat. The heatsink feature 11 may be operable to cool heat-producing elements disposed within the first housing portion 12 and/or the second housing portion 14. In some embodiments, the heatsink feature 11 may be a thin plate shape. The heatsink feature 11 may be operable to cool communication port 16. Communication port 16 may be an electrical port through which a communication cable 60 connects to the works disposed within the interior space of system 10. Although the port is referred to as a "communication port 16" and the cable entering the communication port 16 is referred to as a "communication cable 60," this is for the purpose of conciseness. Those skilled in the art can appreciate that hard wiring for one or more of electrical power connections, electronic connections, communication connections, and so forth may be encased in a watertight casing or cover and included in the communication cable 60. Although the communication port 16 is shown as a hollow cylinder in the figures, this is done for the purpose of illustration rather than limitation. Those skilled in the art can appreciate that there are a myriad of sizes, shapes, and locations for the communication port 16.

In some embodiments, a slipring 15 may be rotatably attached to a distal end of the communication port 16. The slipring 15 may include an opening through which the communication cable 60 enters the communication port 16. The slipring 15 may be adapted to rotate about a longitudinal axis passing through the center of the communication port 16 to prevent tangling.

Figure 2:
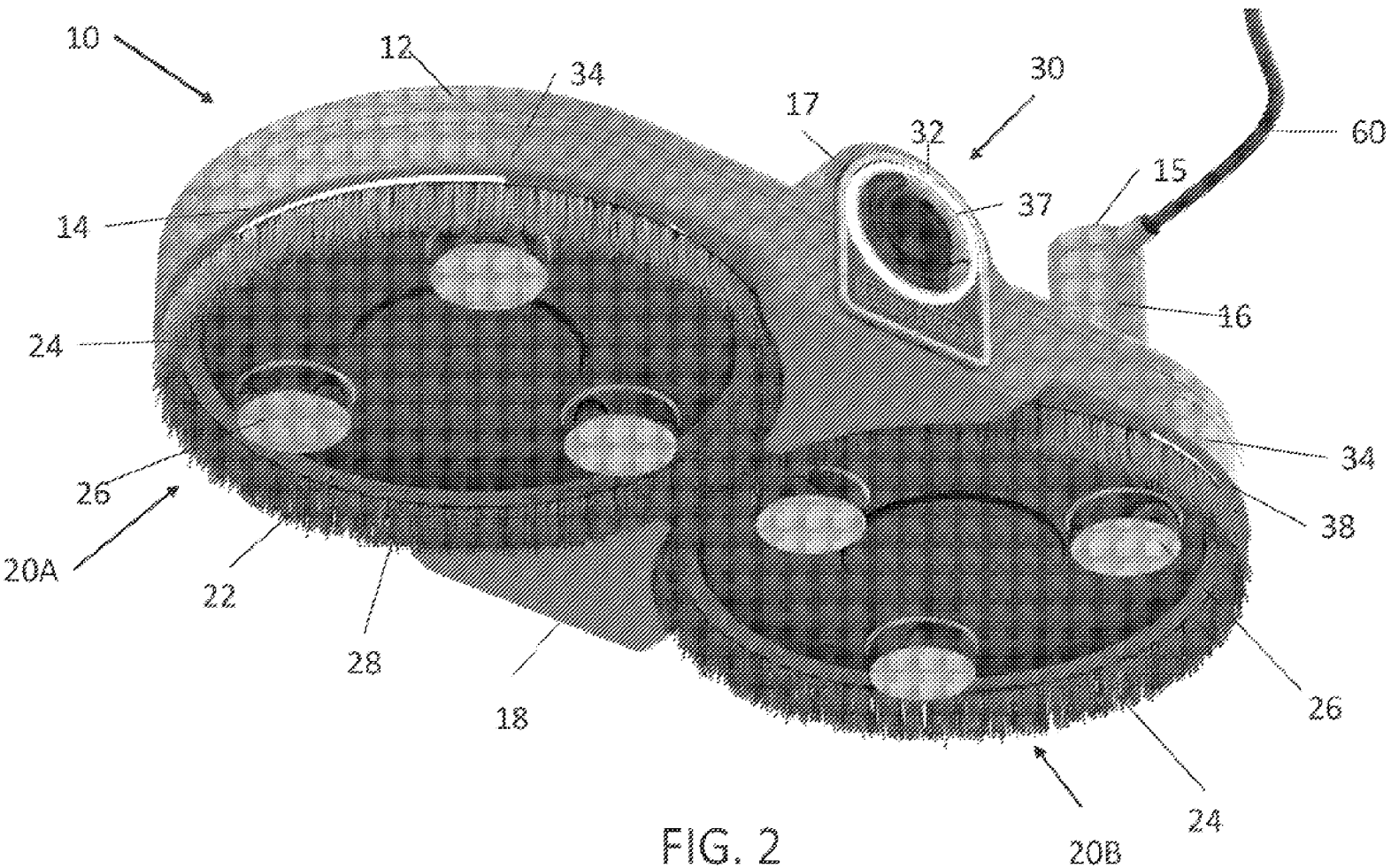
FIG. 2 shows a bottom perspective view of the rear of the system shown in FIG. 1, in accordance with some embodiments of the disclosure.
Figure 3A:
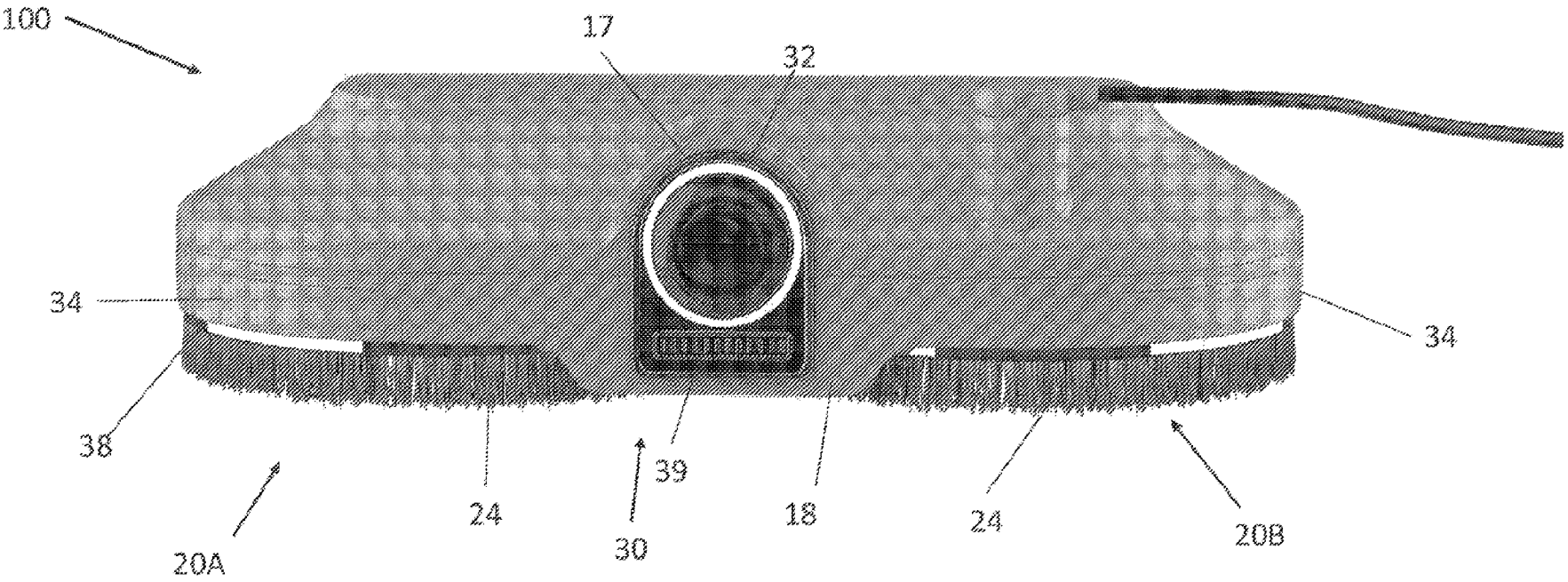
FIG. 3A shows a first side elevation view of the rear of the system shown in FIG. 1, in accordance with some embodiments of the disclosure.
Figure 3B:
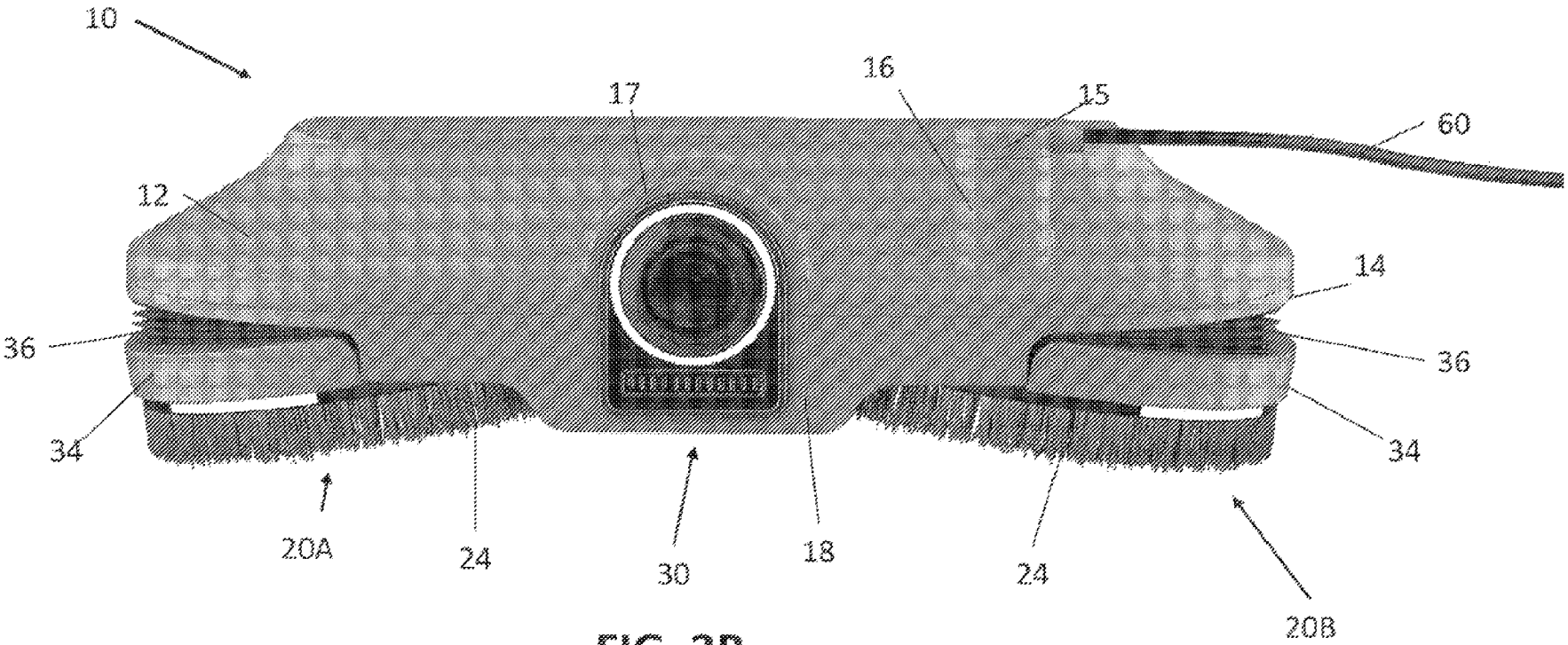
FIG. 3B shows a second side elevation view of the system shown in FIG. 3A, in accordance with some embodiments of the disclosure.

As shown in FIG. 2, FIG. 3A, and FIG. 3B, an arched portion 17 may be formed in a rear portion of the first housing portion 12. In some implementations, the arched portion 17 may be structured and arranged to accommodate all or some portion of a circular connection port 30 that may be provided for selectively and removably attaching an optional tether wand 40 to system 10, as shown below with reference to FIG. 4. In some embodiments, the connection port 30 includes a cylindrical tethering port 32 having a plurality of detents 37 disposed about an inner circumferential surface of the tethering port 32. The plurality of detents 37 may securely retain and/or releasably attach a tether wand 40 to the system 10.

Referring back to FIG. 1, an opening portion 35 may be formed in a front portion of the second housing portion 14. Opening portion 35 may be ovular, circular, elongated, and/or other geometries. In some embodiments, opening portion 35 may be structured and arranged to accommodate a light-emitting element 31. Light-emitting element 31 may be configured to illuminate a portion of an environment. Light-emitting element 31 may include one or more light emitting diodes (LEDs) and/or other light producing elements. An environment illuminated by light-emitting element 31 may include a ship's hull and portions thereof. In some embodiments, opening portion 35 may house an imaging device 33. Imaging device 33 may be a camera, video recorder, and/or other device. Imaging device 33 may be configured to capture discrete, continuous, and/or other images and/or vides of an environment of system 10. In some embodiments, imaging device 33 may capture images and/or videos in a direction of travel of the system 10. In some embodiments, the imaging device 33 may be a wide-angle camera that is configured to provide real time images of the ship's hull. Imaging device 33 may be rotatable about an x-axis, y-axis, and the like, which may enable angled images to be captured by imaging device 33. Images taken by imaging device 33 may be used by a computing device of system 10 and/or a computing device in communication with system 10 to create a map of the ship's hull and/or to provide a visual inspection of the condition of the ship's hull. In other embodiments, for the purpose, inter alia, of providing data for navigation, providing data for accessing the degree of cleaning performed, and so forth, the (e.g., elongate oval) opening portion 35 may be further adapted to accommodate one or more of the following: magnetometers, Hall sensors, structured light spectroscopy, fluorescence spectrometry, other types of spectrometry, and the like.

As shown in FIG. 3A and FIG. 3B, the second housing portion 14 may include a pair of flexible bellows 34 that each include an extendable/retractable waterproof element. Bellows 34 may be rotatable as described above with reference to FIG. 1. In some embodiments, one of the bellows 34 is disposed at a distal end of the second housing portion 14 and the other bellows 34 is disposed at a proximal end of the second housing portion 14. The bellows 34 may be structured and arranged to ensure joint compliance and waterproofing as the system 10 encounters concave and convex surfaces on the ship's hull. Bellows 34 may be structured and arranged to accommodate changing orientations of the plurality of grooming elements 20A, 20B and the adhesion engines 50 (described in further detail below with reference to FIG. 4) as the system 10 traverses the concave, convex, and/or doubly-curved surfaces on the ship's hull. Bellows 34 articulate, may be adapted to extend or retract to maintain a watertight seal of a bottom surface of system 10 and a surface of a ship's hull. In some embodiments, an accordion-like waterproof element may be coupled to each of the bellows 34 and the second housing portion 14, such that when a bellows 34 is extended, the waterproof element deploys and when an extended bellows 34 is retracted, the waterproof element compresses within an interior space of the system 10.

Referring to FIG. 3A. an exemplary embodiment in which the system 10 is operating on a relatively planar surface is shown. FIG. 3B, on the other hand, shows an exemplary embodiment in which the system 10 is operating on a convex surface such that both grooming elements 20A, 20B (and their corresponding adhesion engines 50) are extended. Those of ordinary skill in the art can appreciate that, to accommodate the varying concave and convex surfaces of the ship's hull, the angles of one or both of the grooming elements 20A, 20B may be selectively changed to provide the same or different angles with respect to the bottom surface 38 of the system 10.

As shown in FIG. 3A and FIG. 3B, the rear portion of the second or lower housing portion 14 may also be configured to accommodate all or some portion of the connection port 30. In some embodiments, a docking guidance system 39 may be disposed, for example, beneath the connection port 30. Docking guidance system 39 may include one or more rails that may enable system 10 to navigate and dock back at a central location.

Referring back to FIG. 2, the bottom surface 38 of the second or lower housing portion 14 may be structured and arranged to accommodate the plurality of grooming elements 20A, 20B that may include, for the purpose of illustration rather than limitation, a pair of selectively rotatable brushes 24. A pair of portions 18 may be formed on the front and rear of the second or lower housing portion 14. The portions 18 may also be provided between the grooming elements 20A, 20B to, inter alia, prevent large matter from entering between and possibly jamming up the grooming elements 20A, 20B. The pair of portions 18 may be substantially triangular, in some embodiments. The pair of portions 18 may provide additional surface area and interior spacing for accommodating the connection port 30, the opening portion 35, and some or all of the sensors. Although FIG. 2 only shows two grooming elements 20A, 20B and two selectively rotatable brushes 24, this is done for illustrative purposes only. Those skilled in the art can appreciate that the size (i.e., diameter), number, bristle thickness, and position of the plurality of grooming elements 20A, 20B may be varied.

The plurality of grooming elements 20A, 20B may be structured and arranged to disperse biofilm from the ship's hull into the surrounding water, in an embodiment. In operation, while the adhesion engine 50 (as described below with reference to FIG. 4A) of one grooming element 20A adheres the system 10 to the ship's hull, the other, unanchored rotating grooming element 20B rotates its brushes 24 to actively clean the surface of the ship's hull. In some embodiments, the brushes 24 may protrude between about 1 mm and about 8 mm past the bottom surface of a plurality of magnets 26 used to selectively adhere the grooming element 20A, 20B to the ship's hull. In other embodiments, the brushes 24 may protrude less than 1 mm or greater than 8 mm past a bottom surface of a plurality of magnets 26. This protrusion is what the unanchored adhesion engine 50 of the system 10 may slide on and cleans the surface of the ship's hull. When the magnetic adhesion devices 26 of the unanchored adhesion engine 50 are not enabled or only slightly engaged, the rotating brush 24 is selectively forced against the ship's hull with up to about 600 pounds of force. Advantageously, this force is selectively controllable to provide a force between 1 and 600 pounds. Those skilled in the art can appreciate that the 600 pound force is for a system 10 of a given size and that the force scales up or down depending on the size of the system 10.

In some embodiments, each of the grooming elements 20A, 20B includes a (e.g., circular or disk-shaped) substrate portion 22. In some variations, an attaching or fastening device 28 may be used to removably and securely attach the substrate portion 22 to the second or lower housing portion 14. The diameter and thickness of the (e.g., circular or disk-shaped) substrate portion 22 may be varied to provide a system 10 of a desired size and weight and grooming ability.

As shown in FIG. 2, selectively rotatable brushes 24, e.g., a brush ring, may be fixedly or removably attached about the outer circumference of the substrate portion 22. Those skilled in the art can appreciate that the size of the system 10 is scalable as a function of the diameter of the rotatable brushes 24.

A plurality of selectively controllable, i.e., mechanically-switchable, magnetic adhesion devices 26 may be disposed on the substrate portion 22. The substrate portion 22 may be a planetary ring, in some embodiments. To prevent or minimize biofouling from entering the adhesion area, the magnetic adhesion devices 26 may be disposed between the rotatable brushes 24 and the attaching or fastening device 28. In some embodiments, the adhesion devices 26 may be (e.g., 95-lb.) magnets that are adapted to provide a magnetic field of up to about 250 pounds of force on a ferrous surface. The plurality of selectively controllable, i.e., mechanically-switchable, magnetic adhesion devices 26 on each of the grooming elements 20A, 20B may be switched together, for example, from zero magnetic field to full magnetic field strength. In some embodiments, the strength of the magnetic field of the grooming elements 20A, 20B is selectively adjustable to provide high static adherence at the anchored grooming element 20A of the system 10 to the ship's hull, to pre-load the rotating brushes 24 of the unanchored grooming element 20B, and so forth. Although FIG. 2 only shows three selectively controllable (e.g., magnetic) adhesion devices 26, this is done for illustrative purposes only. Those skilled in the art can appreciate that the size, number, magnetic strength, and position of the selectively controllable (e.g., magnetic) adhesion devices 26 may be varied.

Figure 4A:
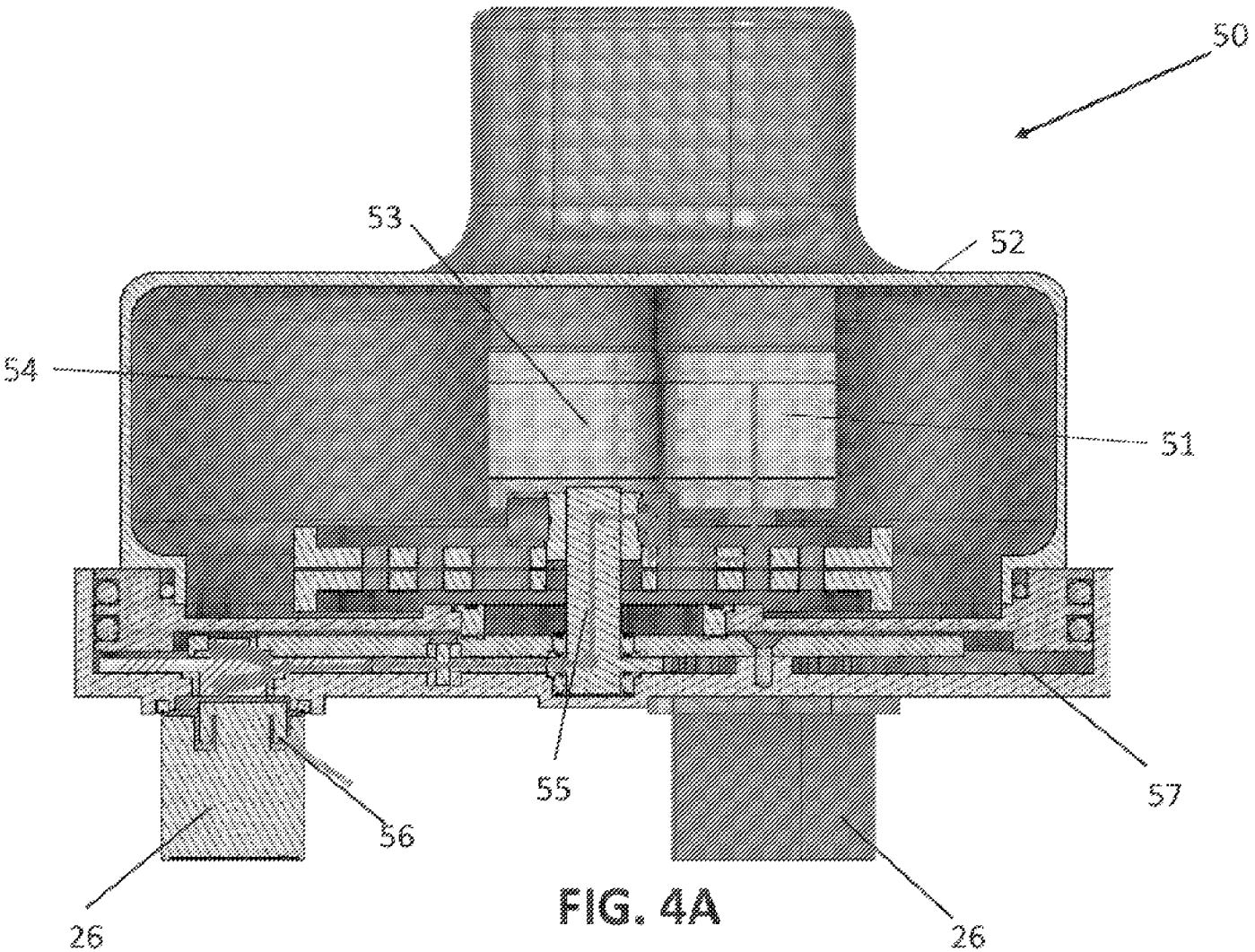
FIG. 4A shows an elevation (side) cross-section view of an adhesion engine, in accordance with some embodiments of the disclosure.
Figure 4B:
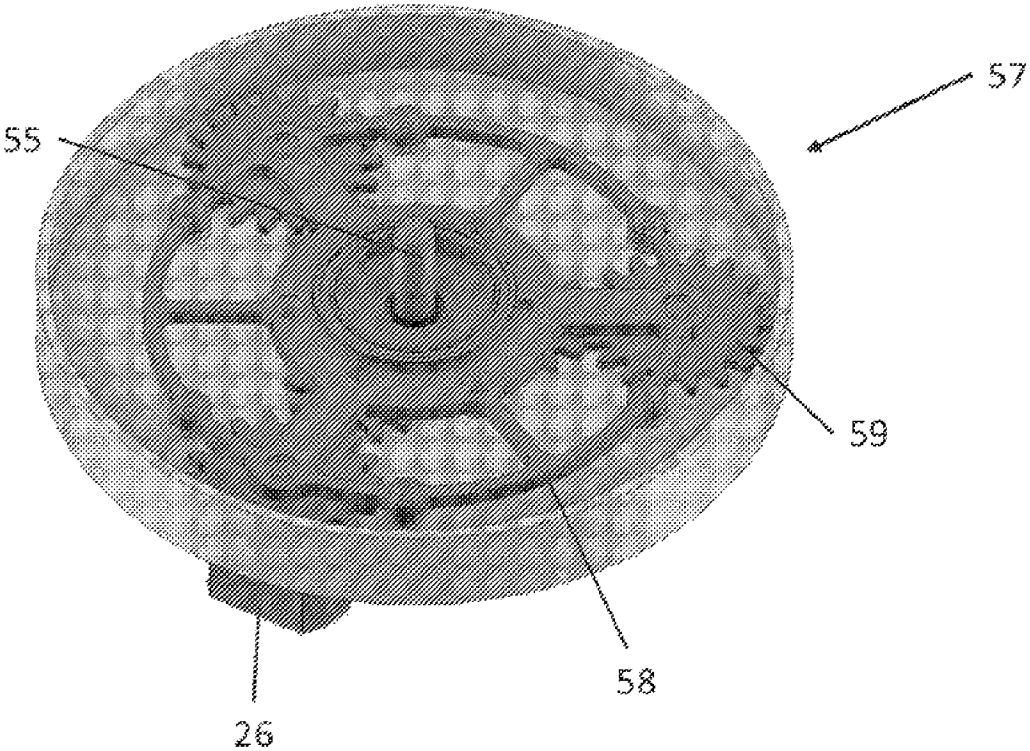
FIG. 4B shows a first view of the mechanical portion of the adhesion engine of FIG. 4A, in accordance with some embodiments of the disclosure.
Figure 4C:
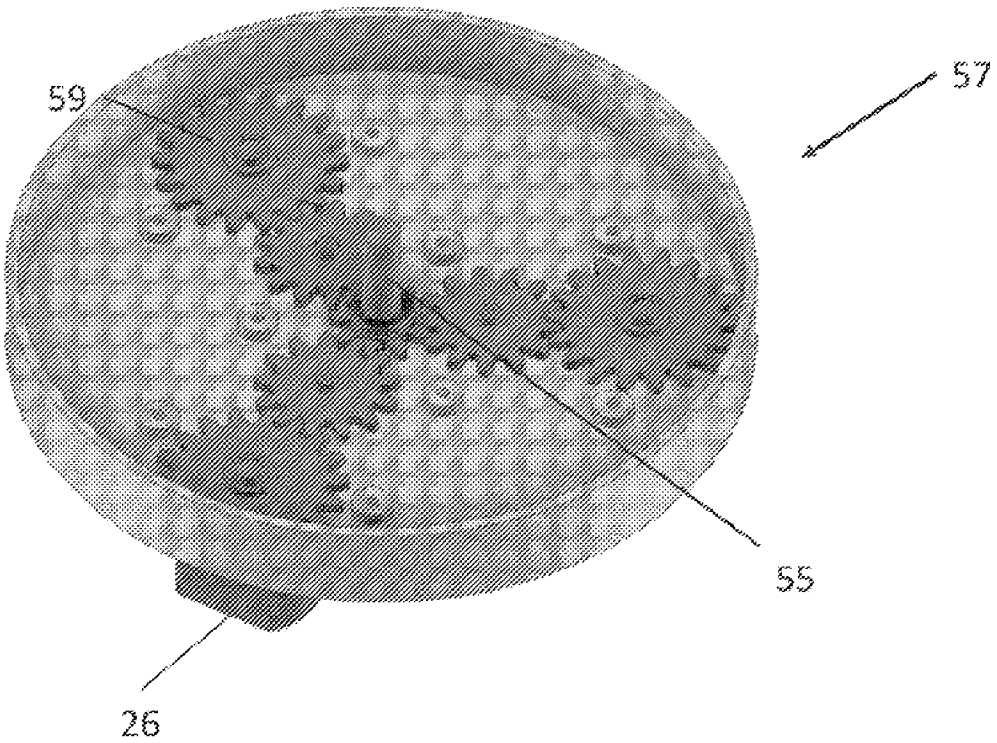
FIG. 4C shows a second view of the mechanical portion of the adhesion engine of FIG. 4A, in accordance with some embodiments of the disclosure.
Figure 5:
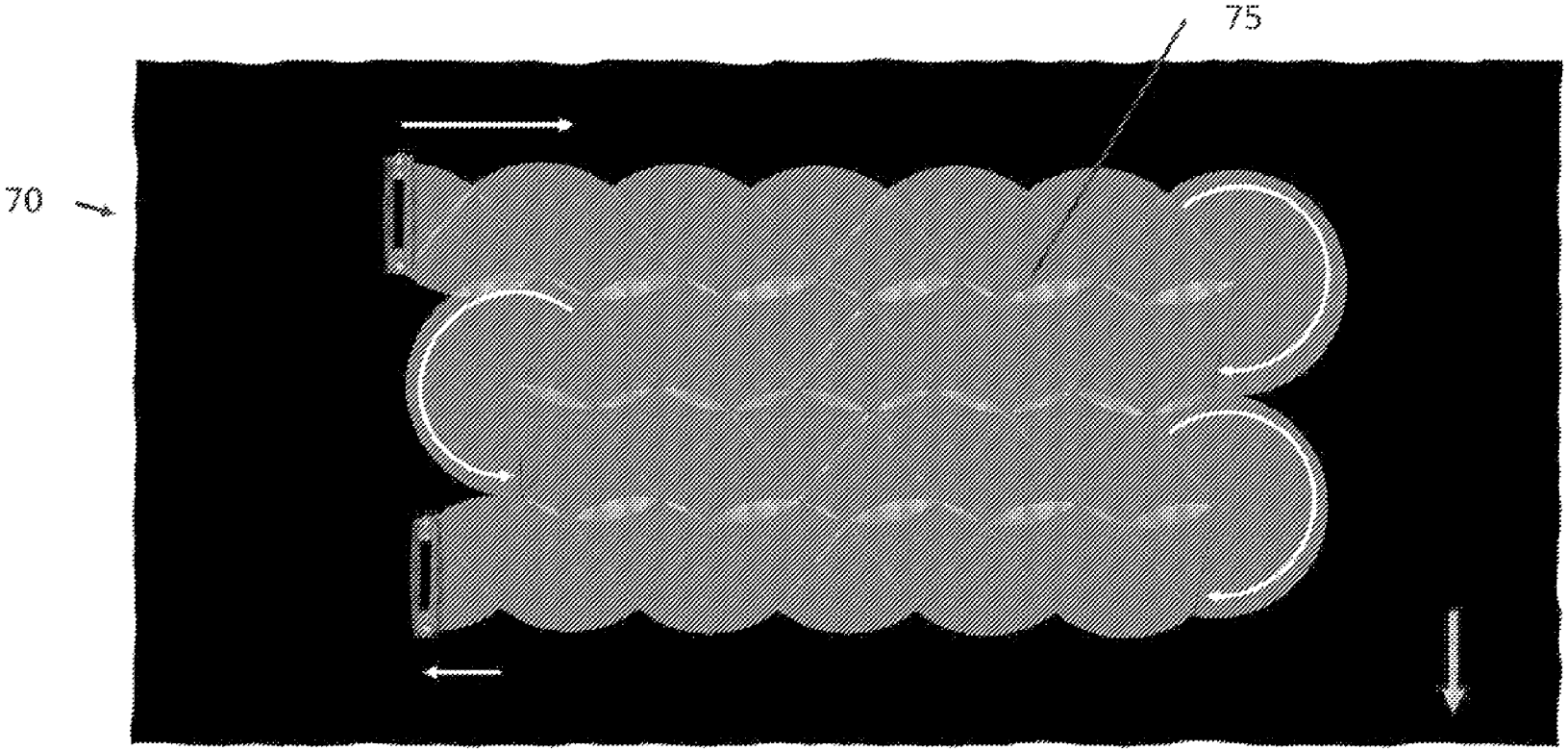
FIG. 5 shows an exemplary cleaning path for the system shown in FIG. 1, in accordance with some embodiments of the disclosure.

Referring to FIGS. 4A-4C, an adhesion engine 50 is shown. For the purpose of this discussion, FIG. 5 shows an exemplary operation of the adhesion engines 50 associated with an anchored grooming element 20A and unanchored grooming element 20B. Those skilled in the art can appreciate that the terms "anchored grooming element 20A" and "unanchored grooming element 20B" are used for convenience, since, in order for the system 10 to translate across the ship's hull, each of the grooming elements 20A, 20B must transition alternately from an anchored state to an unanchored state.

The adhesion engine 50 may be provided for controlling the movement and operation of each of the grooming elements 20A, 20B. Each adhesion engine 50 of a plurality of adhesion engines 50, in some embodiments, may be disposed within an interior space provided by the first housing portion 12 and the second housing portion 14. In some embodiments, the adhesion engine 50 includes its own housing 52 providing an air void within an interior portion 54. In some embodiments, the air void within an interior portion 54 enables the adhesion engine 50 to remain neutrally buoyant.

In some embodiments, the adhesion engine 50 includes the plurality of selectively controllable magnetic adhesion devices 26, a magnet switching motor 51, a body rotation motor 53, and a magnetic switching shaft 55. A switch bar 56 may be magnetically coupled to each of the adhesion devices 26 in the grooming element 20A, 20B. Optionally, to increase surface friction on the anchored grooming element 20A, each of the adhesion devices 26 and/or the entire adhesion engine 50 may include a ring, such as, but not limited to, a silicone ring.

The magnetic switching motor 51 may be structured and arranged to selectively (e.g., mechanically) turn ON/OFF the magnetic adhesion devices 26 associated with the corresponding anchored or unanchored grooming element 20A, 20B. The body rotation motor 53 may be adapted to enable clockwise and counterclockwise rotation of a (e.g., discrete) planetary mechanical system 57 that, in some embodiments, may include a circular grooming element 20A, 20B that is caused to rotate about the switching shaft 55 by a plurality of interconnected gears 59 and a planetary ring 58 that is securely fastened to the outermost gear of the plurality of interconnected gears 59. In operation, the body rotation motor 53 may provide a torque to the switching shaft 55, causing it to rotate. Rotation of the switching shaft 55 may cause the plurality of interconnected gears 59 to rotate, which, in turn, may cause the planetary ring 58 to rotate. Rotation of the planetary ring 58 may cause rotation of the brushes 24 of the unanchored grooming element 20B.

The unanchored grooming element 20B may be the moving and cleaning/grooming element. In some embodiments, the brushes 24 rotate in a counterclockwise direction such that biofouling removed from the surface of the ship's hull is pushed away from the center of the system, i.e., the anchored grooming element 20A. If any of the debris is magnetic, it may be attracted to and possibly attached to one or more of the adhesion devices 26. Since the adhesion devices 26 are alternatingly turned ON and OFF, any collected debris may fall away from the affected adhesion device 26 when it is turned OFF, in an embodiment. While the brush 24 of the unanchored grooming element 20B moves in a clockwise (or, alternatively, a counterclockwise) direction about the anchored grooming element 20A, the unanchored grooming element 20B may, itself, rotate in the antidirection of the adhesion engine 50 of the anchored grooming element 20A.

Method of Movement

Referring now to FIG. 5, a method of operation 75 on ship hull 70 is shown. In a first step, the magnet switching motor 51 of the anchored grooming element 20A may be controlled to turn ON the adhesion devices 26 on the anchored grooming element 20A, securing the anchored grooming element 20A to the ship's hull, while the magnet switching motor 51 of the unanchored grooming element 20B may be controlled to turn OFF the adhesion devices 26 on the unanchored grooming element 20B to enable it to rotate (e.g., in a clockwise direction) about the anchored grooming element 20A. In a next step, while the magnet switching motor 51 and body rotation motor 53 of the unanchored grooming element 20B are synchronized to rotate the brushes 24 of the unanchored grooming element 20B, the magnet switching motor 51 and body rotation motor 53 of the anchored grooming element 20A may be synchronized to rotate (e.g., in a clockwise direction) the unanchored grooming element 20B about the anchored grooming element 20A.

Once the grooming element 20B has completed cleaning and grooming the ship's hull to the extent that it can, rotation of the brushes 26 may be stopped and the magnet switching motor 51 of the grooming element 20B may be controlled to turn ON the adhesion devices 26 on the grooming element 20B, securing the grooming element 20B to the ship's hull, while the magnet switching motor 51 of grooming element 20A may be controlled to turn OFF the adhesion devices 26 on grooming element 20A to enable it to rotate (e.g., in a counterclockwise direction) about grooming element 20B.

In a next step, while the magnet switching motor 51 and body rotation motor 53 of grooming element 20A are synchronized to rotate the brushes 24 of grooming element 20A, the magnet switching motor 51 and body rotation motor 53 of grooming element 20B may be synchronized to rotate (e.g., in a counterclockwise direction) grooming element 20A about grooming element 20B. This process can be repeated until the system 10 requires a 180-degree change in direction.

In some embodiments, to eliminate the need for sliprings, due to the location of the motors 51, 53 on the non-rotating portion, in order to rotate the adhesion engine 50 about the anchored grooming element 20A, the magnet switching motor 51 and the body rotation motor 53 may move at a same rotations per minute (RPM) value. In some variations, controlling the magnet switching motor 51 and the body rotation motor 53 to move at the same RPM may be accomplished using encoder feedback.

Tethering System

Figure 6:
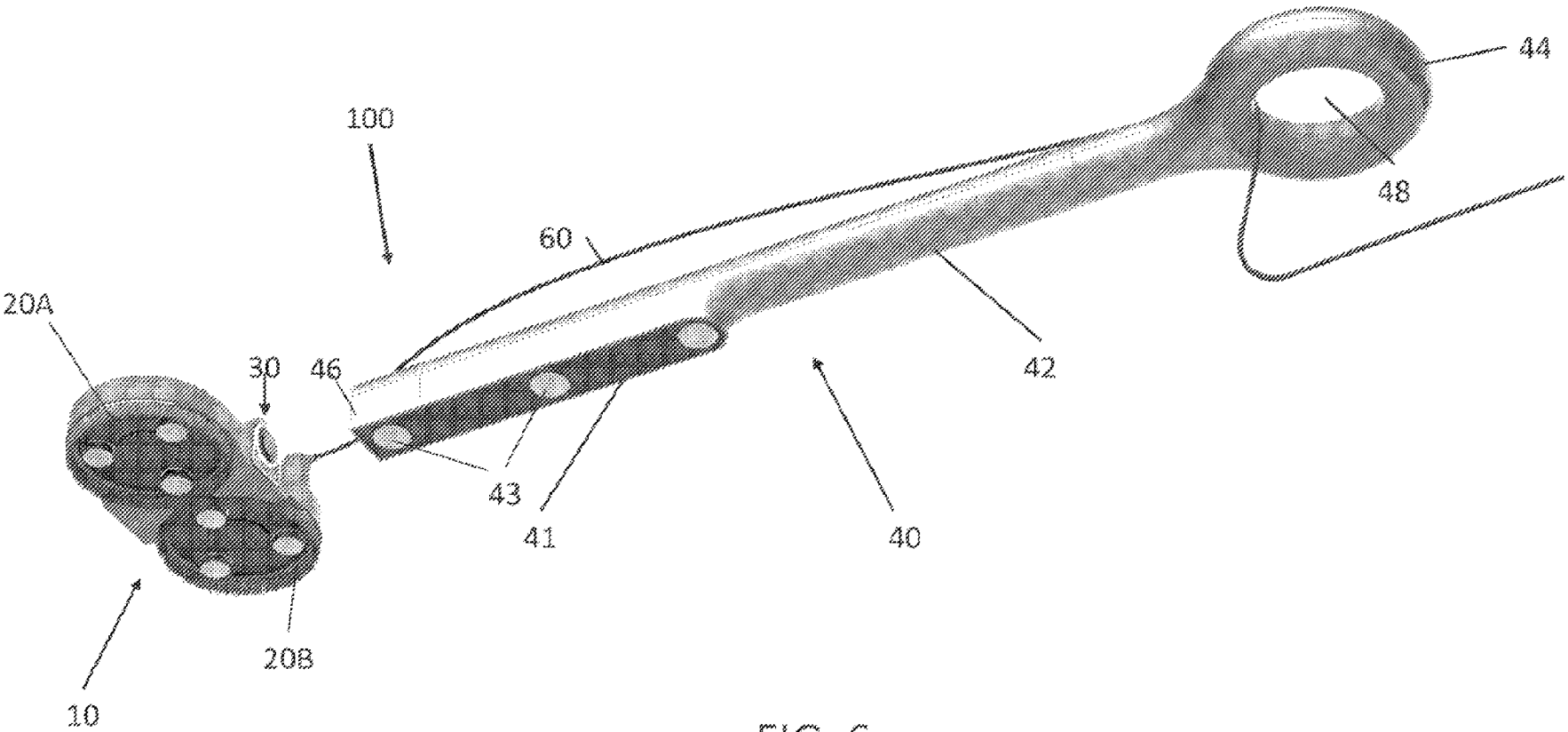
FIG. 6 shows a bottom perspective view of the system shown in FIG. 1 detachably affixed to a tethering wand, in accordance with some embodiments of the disclosure.
Figure 7A:
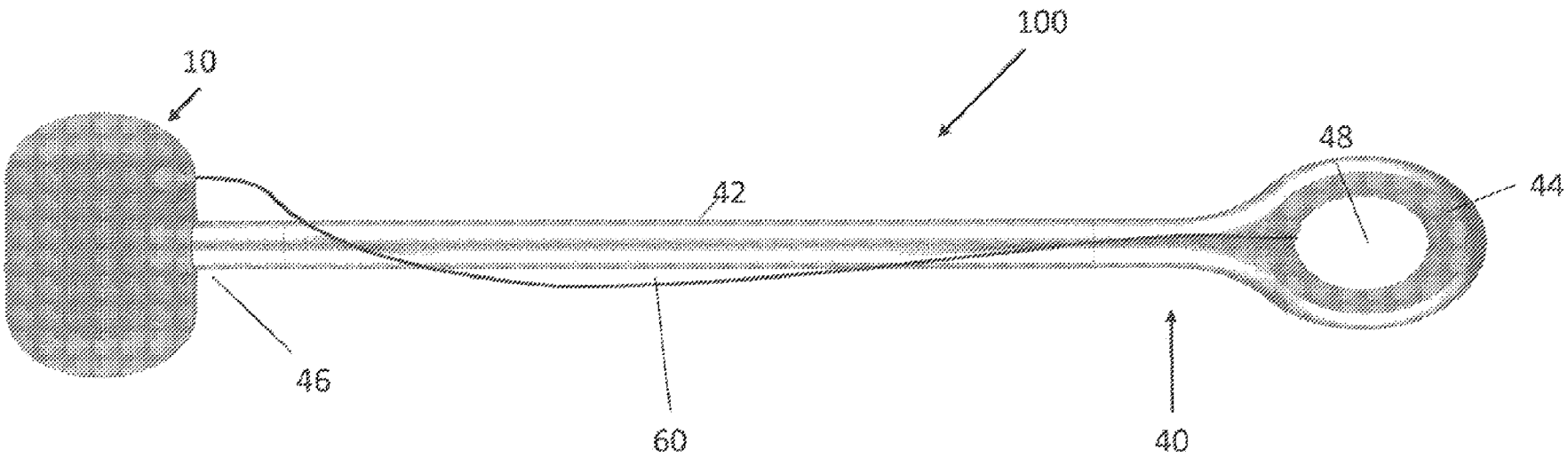
FIG. 7A shows a top (plan) view of the system shown in FIG. 1 detachably affixed to a tethering wand, in accordance with some embodiments of the disclosure.
Figure 7B:
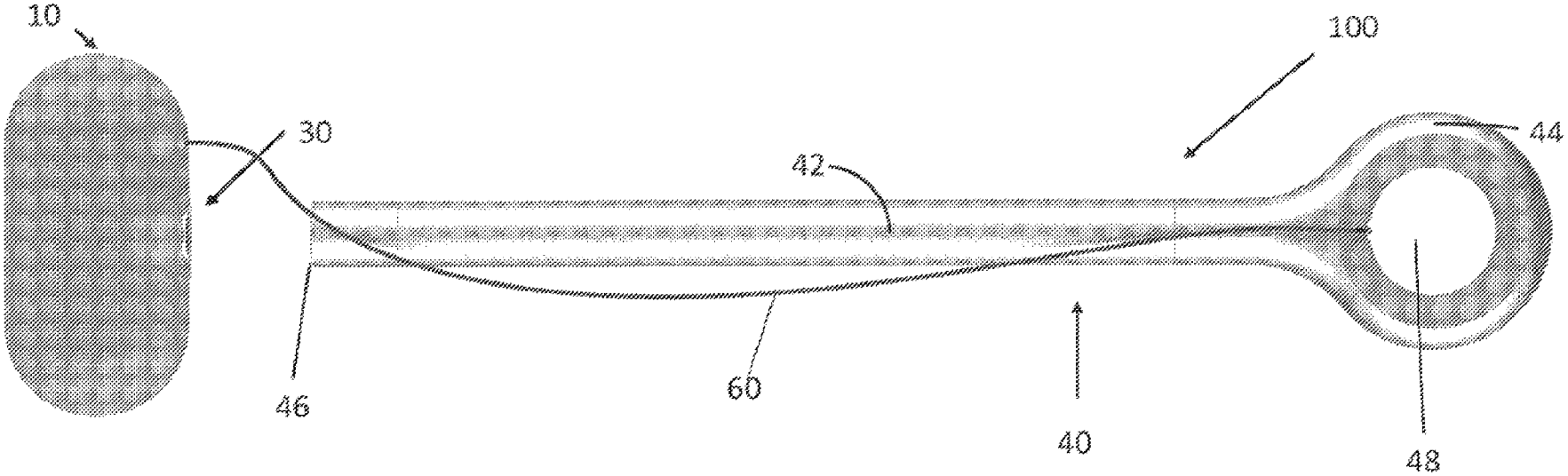
FIG. 7B shows a top (plan) view of the system shown in FIG. 1 detached from the tethering wand of FIG. 7A, in accordance with some embodiments of the disclosure.

Referring to FIGS. 6, 7A, and 7B, an illustrative embodiment of a tethered system 100 is shown. A tethered system 100 may allow for live-streaming of data (e.g., via the communication cable 60). However, when untethered, the system 10 may not be restricted by tether management, and, accordingly, may travel to hard-to-reach areas, such as the bottom of the hull (e.g., the keel).

In some embodiments, the tethered system 100 includes a tethering wand 40 that includes an elongate portion 42 having a proximal end 44 and a distal end 46. In some implementations, the proximal end may include an opening 48 through which the communication cable may be routed. In order to secure the tethering wand 40 to the ship's hull, a plurality of adhesion devices (e.g., magnets) 43 may be disposed on a bottom portion 41 of the elongate portion 42, near the distal end 46. A docking portion disposed at the distal end of the elongate portion 42 may be structured and arranged to mate with the connection portion 30 of the system 10.

Central Processing System and Memory

Figure 8:
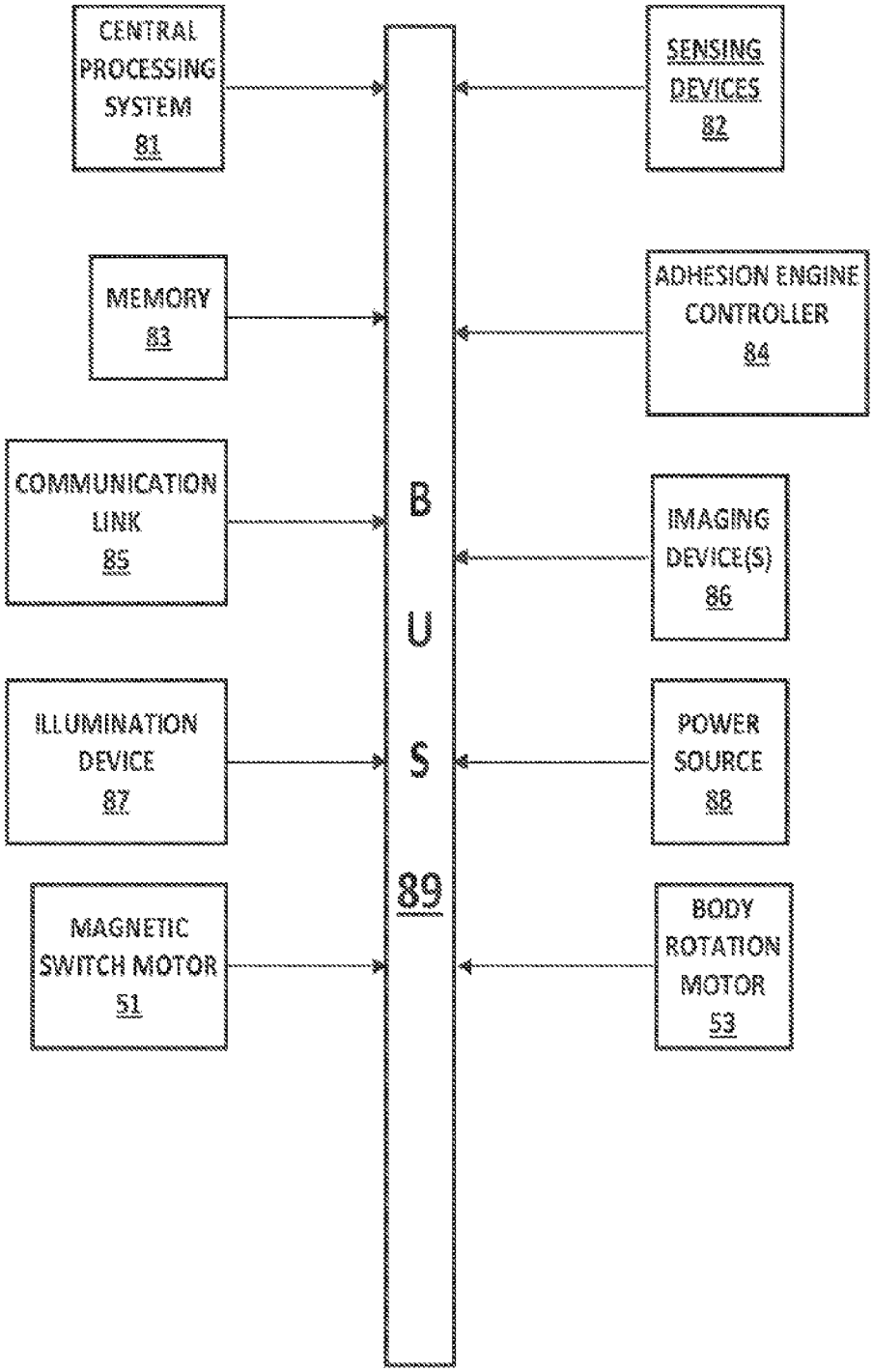
FIG. 8 shows a block diagram of the system shown in FIG. 1, in accordance with some embodiments of the disclosure.

Referring to FIG. 8, the features for controlling the system 10 will be described. In some embodiments, the system 10 may include one or more of the following: a central processing system 81, a plurality of sensing devices 82, memory or storage 83, a master controller 84, communication link 85, an imaging device 86, an illumination device 87, and a power source 88 that are electrically and/or electronically coupled to one another via a bus 89, as well as being operatively coupled to the magnet switching motor 51 and the body rotation motor 53 of each of the first and second adhesion engines 50.

Implementations of the subject matter and the operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on computer storage medium (i.e., memory 83) for execution by, or to control the operation of, data processing apparatus (i.e., central processing system 81). Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus (i.e., central processing system 81). A computer storage medium (i.e., memory 83) can be, or be included in, a computer-readable storage device, a computer-readable storage substrate, a random or serial access memory array or device, or a combination of one or more of them. Moreover, while a computer storage medium (i.e., memory 83) is not a propagated signal, a computer storage medium (i.e., memory 83) can be a source or destination of computer program instructions encoded in an artificially-generated propagated signal. The computer storage medium (i.e., memory 83) can also be, or be included in, one or more separate physical components or media (e.g., multiple CDs, disks, or other storage devices).

The operations described in this specification can be implemented as operations performed by a data processing apparatus (i.e., central processing system 81) on data stored on one or more computer-readable storage devices (i.e., memory 83) or received from other sources.

The term "data processing apparatus" encompasses all kinds of apparatuses, devices, and machines for processing data, including by way of example a programmable processing device (i.e., a processor), a computer, a system on a chip, or multiple ones, or combinations, of the foregoing. The data processing apparatus (i.e., central processing system 81) may include special purpose logic circuitry, e.g., an FPGA (field programmable gate array) or an ASIC (application-specific integrated circuit). The data processing apparatus (i.e., central processing system 81) may also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language resource), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification may be performed by one or more programmable processors executing one or more computer programs to perform actions by operating on input data and generating output. The processes and logic flows may also be performed by, and apparatus can also be implemented as, special purpose logic circuitry, e.g., an FPGA or an ASIC. In some implementations, the processes and logic flows described in this specification may be performed by one or more programmable processors disposed remotely (e.g., on the naval vessel) from the system 10. Advantageously, in some implementation of the system 10, a swarm or plurality of systems 10 may be cleaning/grooming the ship's hull concurrently. In such an application, a master controller structured and arranged to receive, in real time, data from each of the systems 10 and to control (e.g., navigate) each of the systems 10 may be disposed remotely (e.g., on the naval vessel).

Processors suitable for the on-board central processing systems 81 and the remote, on-broad master controller and for execution of a computer program include, by way of example, both general and special purpose microprocessors, and any one or more processors of any kind of digital computer (e.g., a Jetson Nano manufactured by NVIDIA). Generally, a processor will receive instructions and data from a read-only memory or a random access memory 83 or both. The essential elements of a computer are a processor for performing actions in accordance with instructions and one or more memory devices 83 for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The central processing system 81 and the memory 83 can be supplemented by, or incorporated in, special purpose logic circuitry.

To provide for interaction with a user, implementations of the subject matter described in this specification can be implemented on a remote master controller having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending resources to and receiving resources from a device that is used by the user.

Implementations of the master controller described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The remote master controller and the central processing system 81 on each system may be interconnected by any form or medium of digital data communication, e.g., a communication network or link 85. Examples of communication networks or links 85 include hardwired peer-to-peer networks (e.g., ad hoc peer-to-peer networks), an Ethernet, and/or WiFi.

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Imaging and Illumination Devices

Still referring to FIG. 8, as previously mentioned, in some implementations, the system 10 may be configured to include an imaging device 86 and/or an illumination device 87. In some variations, the system 10 may be structured and arranged to accommodate an illumination device 87 comprising a light-emitting element 31 that is capable of illuminating some portion of the environment (e.g., the ship's hull) in a direction of travel of the system 10, as well as an imaging device 86 for capturing (e.g., discrete or continuous) images of the environment (e.g., the ship's hull) in a direction of travel of the system 10. In some implementations, the illumination device 87 may include a light-emitting element 31 such as a UV lamp. Advantageously, to increase the time between cleanings, the UV lamp may be used to treat the surface of the ship's hull to prevent growth of organic organisms. In some variations, the imaging device 86 may be a wide-angle camera 33 that is configured to provide, in real time images, of the ship's hull or a LiDAR system. Advantageously, such images may be used to create a map of the ship's hull, as well as to provide a visual inspection of the condition of the ship's hull. A map of the ship's hull may be a three-dimensional or two-dimensional mapping. Visual inspection of the condition of the ship's hull may include identification of debris, marine life, structural integrity, and the like by system 10 and/or a computing device in communication with system 10. In some embodiments, system 10 may be configured to utilize an image recognition and/or classification model that may identify cleanliness levels of a ship's hull, categories of debris/marine life, and/or other image categories. For instance, and without limitation, system 10 may input one or more images and/or videos and output bounding boxes and/or pixel-level segmentations of objects of interest. An image recognition model may be trained with training data correlating images to one or more categories such as, but not limited to, cleanliness levels, marine life, debris, and the like. Training data may be received through user input, external computing devices, and/or previous iterations of processing. In some embodiments, system 10 may train and/or deploy an image recognition process locally. In other embodiments, system 10 may communicate with an external computing device which may train and/or deploy an image recognition process and communicate outputs of the image recognition process to system 10. System 10 may utilize an image recognition process to determine types of marine life, such as, but not limited to, barnacles, hermit crabs, muscles, and/or other marine life. System 10 may utilize an image recognition process to determine types of debris, such as, but not limited to, rocks, dirt, wood, biofilm, and/or other debris types. System 10 may utilize an image recognition process to determine levels of cleanliness of a ship's hull, such as, but not limited to, dirty, average, clean, and the like. System 10 may utilize one or more outputs of an image recognition process to determine traversal paths, adhesion levels, cleaning operations, and/or other functions. Other embodiment might utilize structured light implementation elements and projections to further determine the shape, sizes, and other visually attainable characteristics of including but not limited to, the hull's surface, rocks, dirt, wood, marine life, biofilm, and/or other debris types.

Power Source

With continued reference to FIG. 8, power, for example, from a remote AC power supply for the electrical and electronic components of each system 10 may be provided via the communication cable 60. Alternatively, or as an auxiliary power source, each system 10 may include an on-board (e.g., LiPo) battery pack 88. The size of the on-board battery pack 88 may depend on whether or not the system 10 is tethered or untethered. For example, the size (voltage) of a battery pack 88 for an untethered system 10 may be larger than that needed for a tethered system 10. More specifically, if the system 10 is tethered, each tethering wand 40 may be configured to include a larger battery pack, a solar panel, and so forth to provide power to the system 10.

Adhesion Engine Controller

Referring still to FIG. 8, as previously described, each system 10 may include a plurality of adhesion engines 50 that may be alternatively controlled to selectively turn ON/OFF the adhesion devices 26 and grooming elements 20A, 20B. The adhesion engine controller 84 is adapted to control each magnetic adhesion element 26 and grooming element 20A, 20B of the adhesion engines 50, such that the anchored grooming element 20A (e.g., fixedly) controlled by the first adhesion engine 50 (e.g., fixedly) adheres the system 10 to the ship's hull, while the other, unanchored (e.g., rotating) grooming element 20B controlled by the second adhesion engine 50 rotates its brushes 24 to actively clean the surface of the ships' hull. As shown in FIG. 5, the adhesion engine controller 84 is structured and arranged to navigate each system 10 to clean/groom a desired path across the ship's hull.

Sensing Devices

With continued reference to FIG. 8, the system 10 includes a plurality of sensors 82 that may be used, for example, for localization of the system, path planning (i.e., navigation) of the system, collecting data on ship's hull's condition, and so forth. Exemplary sensors 82 that may be included in the system 10 may include one or more of the following: a motor encoder for positioning and magnet engagement operations; a motor current sensor for collision detection, surface friction feedback (from the brushes 24), and/or for detecting magnetic field engagement; a magnetometer(s) for detecting adhesion of the adhesion devices 26, material thickness, and/or gap distance; linear distance sensors for sensing physical contact distance to weld lines or other hull features; adhesion engine angle sensors for detecting curvature of the ship's hull at discrete locations and for normalizing linear distance sensor data; ultrasound for detecting paint thickness, thickness of the steel hull, and detecting weld lines, inner welded ribs, and the like; Eddy current sensors for detecting paint thickness, thickness of the steel hull, and detecting weld lines, inner welded ribs, and the like; optical flow sensors to detect fluid flow; optical sensors/devices for visually navigating the system and inspecting the underwater conditions; inertial measurement units (IMUs) for navigation, localization, collision detection, and the like; depth sensors; pressure sensors; temperature sensors; and so forth. Sensing system hierarchy is summarized in the table shown in FIG. 9.

Surface Friction Detection and Water Velocity Detection Using Current Sensors

Advantageously, as the system 10 cleans the ship's hull, motor current feedback from current sensors associated with the adhesion engines 50 may be used to detect how fouled or rough the surface of the ship's hull is, as well as the speed of the water or other fluid. More specifically, current is used to provide torque to rotate the unanchored grooming element 20B. If movement of the unanchored grooming element 20B is affected by the surface roughness and/or water speed, then more torque (hence more current) may be needed to negotiate the surface roughness or address the water velocity. Accordingly, the associated current sensors may be used to provide information about surface roughness and/or water speed. A summary of current sensing is provided in FIG. 10. In some embodiments, a body of system 10 may be used as a sensor itself. For instance, system 10 may include one or more sensors disposed throughout a body of system 10 that may be configured to detect various forces applied to a body of system 10, such as, but not limited to, adhesion, pressure, pulling forces, pushing forces, and the like. A body of system 10 may have one or more flexible structures. Each flexible structure of a body of system 10 may be equipped with force sensors, encoders, and/or other sensors that may be used to calibrate system 10 and/or provide for sensing redundancies.

System Navigation and Localization Using Weld Line and Interior Rib Detection

Figure 11:
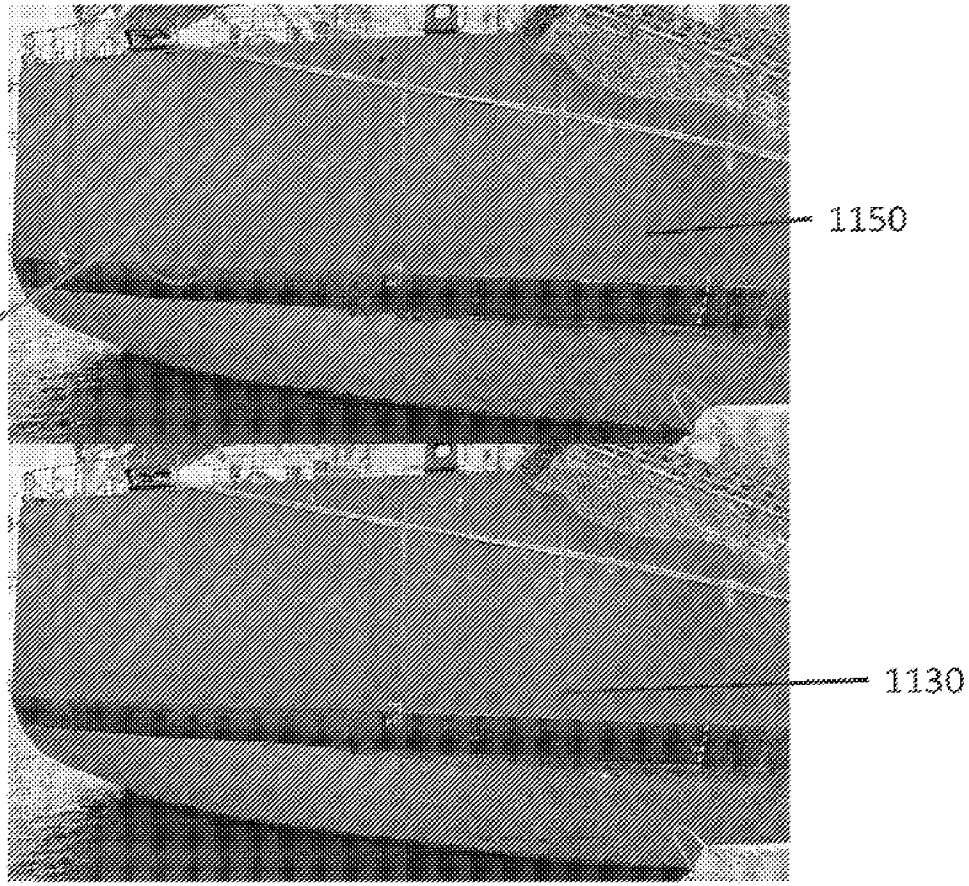
FIG. 11 shows surface weld lines and protrusions from internal rib welds on a ship's hull for use in localization, in accordance with some embodiments of the disclosure.
Figure 12:
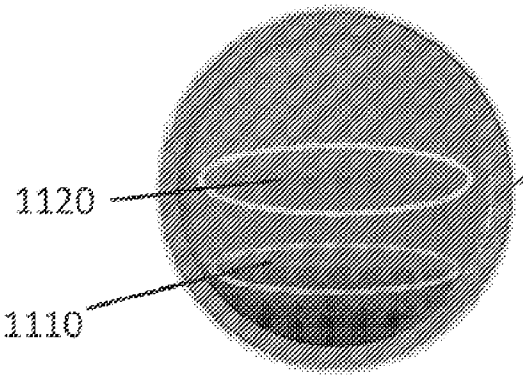
FIG. 12 shows a detail of the surface weld lines and protrusions from internal rib welds in FIG. 11, in accordance with some embodiments of the disclosure.

As shown in FIGS. 11 and 12, the ship's hull 1100 may include a plurality of surface weld lines 1110 and, in some instances, protrusions 1120 of internal rib welds. Typically, surface welds 1110 are linear protrusions that are between about 1 mm and about 10 mm in height and that can range in width from about 2 mm to about 25 mm. The surface weld lines 1110 enable the user to break down the surface of the ship's hull into (e.g., discrete) segments 1150 that may be used for localization and navigation of the system 10. Protrusions 1120 of internal rib welds provide a further means for breaking down the ship's hull into discrete sections. Breaking down the ship's hull into a plurality of (about 40 ft.×10 ft. or smaller) segments 1150 bounded by weld lines 1110 and/or (about 2 ft.×2 ft. sections) protrusions 1120 of internal rib welds, enables the user to clean the ship's hull section by section or segment by segment. With the additional detection of interior rib protrusions 1120 (e.g., using ultrasound, Eddy current, or minute detection of the surface change with distance sensors), the error of system navigation can be greatly reduced.

Advantageously, localization of the system 10 within a discrete segment of the ship's hull—rather than bounding a system 10 the full length and width of the ship—enables the user to navigate the system 10 within weld lines 1110 of a discrete segments 1150. Thus, errors in navigation are not compounded outside of a discrete segment 1150. Indeed, the systems 10 can easily detect the corners 1130 of weld line segments 1110, facilitating path planning to clean back and forth (FIG. 5) within those segments 1150. Importantly, the actual shape and geometry of the ship's hull within any segment 1150 does not need to be mapped beforehand, as the system 10 can easily walk the perimeter of the weld line 1110, and then plan a cleaning path.

Navigation Using Eddy Currents

Figure 13:
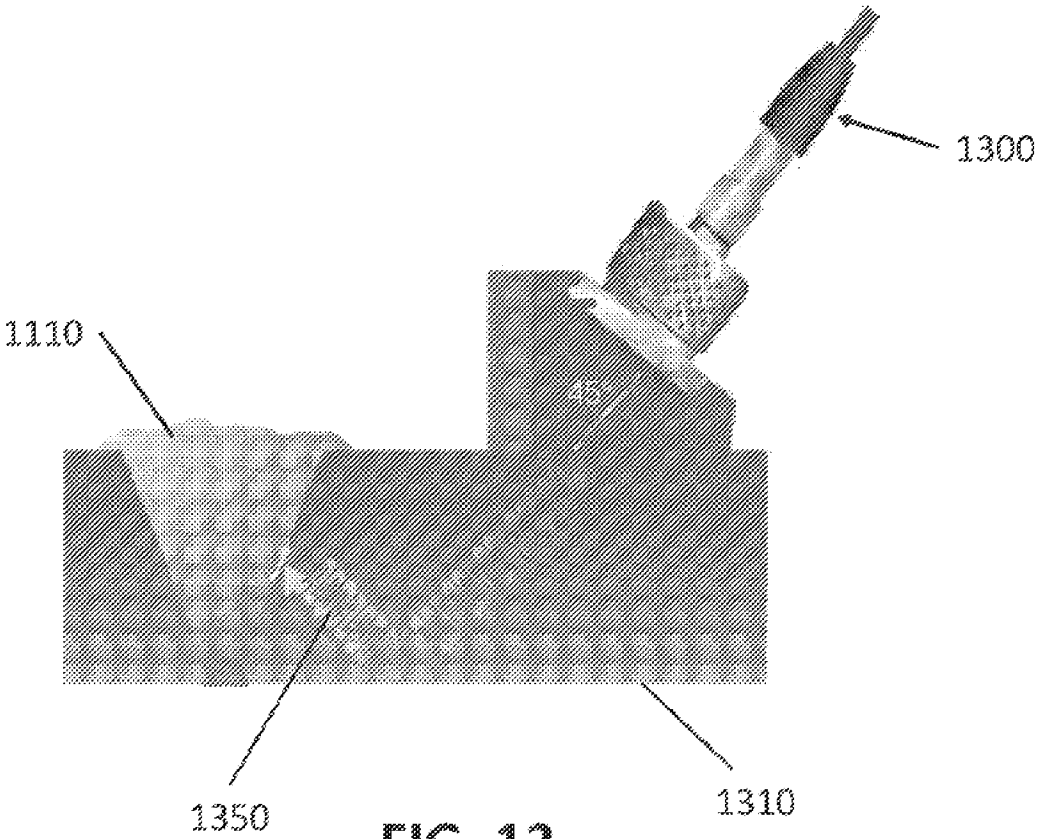
FIG. 13 shows an illustrative embodiment of using ultrasound or Eddy current devices for localization on a ship's surface, in accordance with some embodiments of the disclosure.

Referring to FIG. 13, a further illustrative method of navigation is shown. Whereas the use of weld lines 1110 and protrusions 1120 of interior ribs does not require mapping of the surface of the ship's hull, ultrasound and/or Eddy currents may be used to map the surface of the ship's hull to create, for example, a look-up table of unique responses at known points. Preferably, the look-up table may be stored in memory provided for that purpose. Ultrasound and/or Eddy current responses resonate off of signatures such as the curvature of the ship's hull, weld lines 1110, interior rib protrusions 1120, and defects (e.g., scratches, pitting, dents, and the like), obstructions, and the like of the surface of the ship's hull. Thus, each signature detected using ultrasound and/or Eddy current may be used to identify a unique location on the surface of the ship's hull.

As shown in FIG. 13, the ultrasound and/or Eddy current device 1300 may be disposed on the system 10 and adapted to emit the signal 1350 that is reflected at a free surface 1310 (e.g., the interior surface of the ship's hull). Once the reflected signal encounters, for example, a weld line 1110, the signal 1350 is reflected back to the ultrasound and/or Eddy current device 1300.

Distance sensors may also be used to detect weld lines, protrusions, defects, obstructions, and the like of the surface of the ship's hull, enabling minute detection of surface changes. For example, distance sensors may be adapted to ascertain the nature (e.g., orientation, thickness, and so forth) of the protrusions 1120 of internal rib welds, as well as the curvature, protrusions, defects, obstructions, and the like of the surface of the ship's hull. These data may provide unique, distinctive characteristics that are detectable and measurable by the sensors of the system 10. The central processing system may use these data, first, to determine the location (i.e., the discrete segment of the ship's hull) of the system 10. Having determined the location of the system 10, the central processing system may use these data to determine a path for the system 10 to follow to efficiently clean/groom the surface of the ship's hull. Advantageously, navigational signals sent to the system 10 from the central processing system may be saved and stored in memory for re-use during future cleaning/grooming operations within the same discrete segment of the ship's hull.

Physical Distance and Angle Sensing for Localization Using Ship Hull Curvature

Figure 14A:
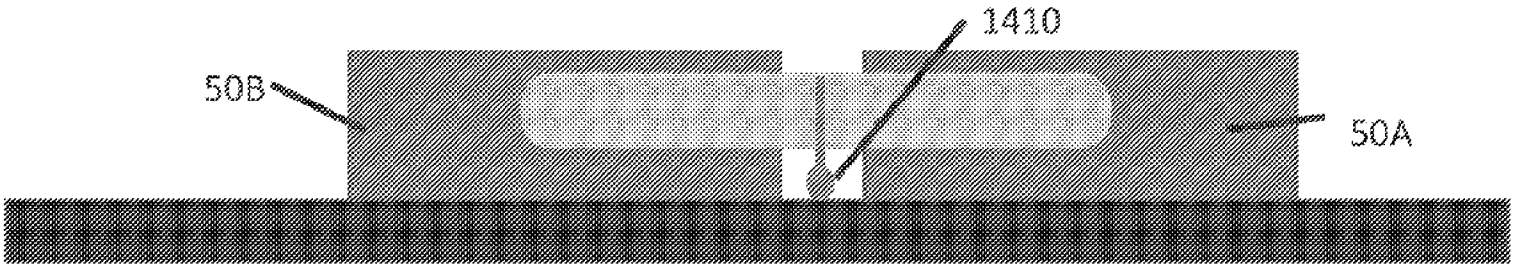
FIG. 14A shows an illustrative embodiment of physical distance and angle sensors on a planar surface, in accordance with some embodiments of the disclosure.
Figure 14B:
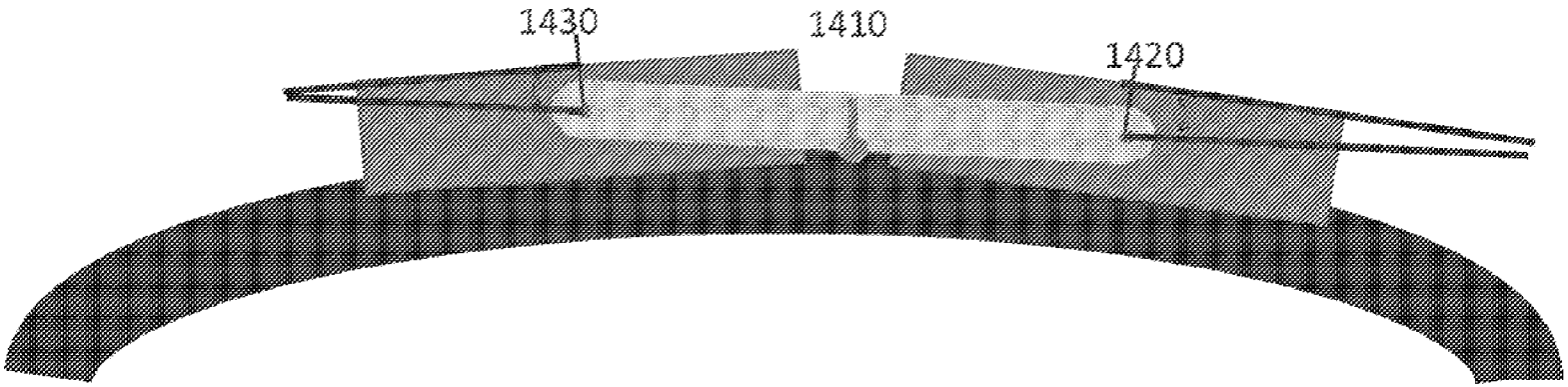
FIG. 14B shows an illustrative embodiment of physical distance and angle sensors on a curved surface, in accordance with some embodiments of the disclosure.

Referring to FIGS. 14A and 14B, use of a physical distance sensor (e.g., a dial indicator) 1410 in combination with a plurality of (e.g., two) angle sensors 1420, 1430 to determine the curvature of the surface of the ship's hull at or between discrete locations on the surface of the ship's hull is shown. Advantageously, distance data from the physical distance sensor 1410 and the related angle of rotation of the surface of the ship's hull from each angle sensor 1420, 1430 may be provided in, for example, a look-up table of radii of curvature that may be stored in memory provide for that purpose. As shown in FIG. 14A, when the system 10 rests on a planar surface, the angle of rotation associated with the angle sensor 1420 incorporated on a first adhesion engine 50A and the angle of rotation associated with the angle sensor 1420 incorporated on a second adhesion engine 50B are each, essentially, zero (0). As the system 10 translates along the surface of the ship's hull and encounters and/or follows the hull's curvature, the physical distance sensor 1410 may record a distance (e.g., 22.42 mm) from a previous point and the angle sensor 1420 incorporated on the first adhesion engine 50A may record a first angle of rotation (1.9 degrees) and the angle sensor 1430 incorporated on the second adhesion engine 50B may record a second angle of rotation (1.9 degrees), which measurements may be used (e.g., by the central processing system) to calculate a radius of curvature of 2561.5 mm. The look-up table of magnitudes of the radius of curvature may then be used for localization purposes, which enables the central processing system to narrow down where on the surface of the ship's hull a corresponding curvature of such a magnitude is located.

Adhesion and Gap Detection Sensing

Figure 15:
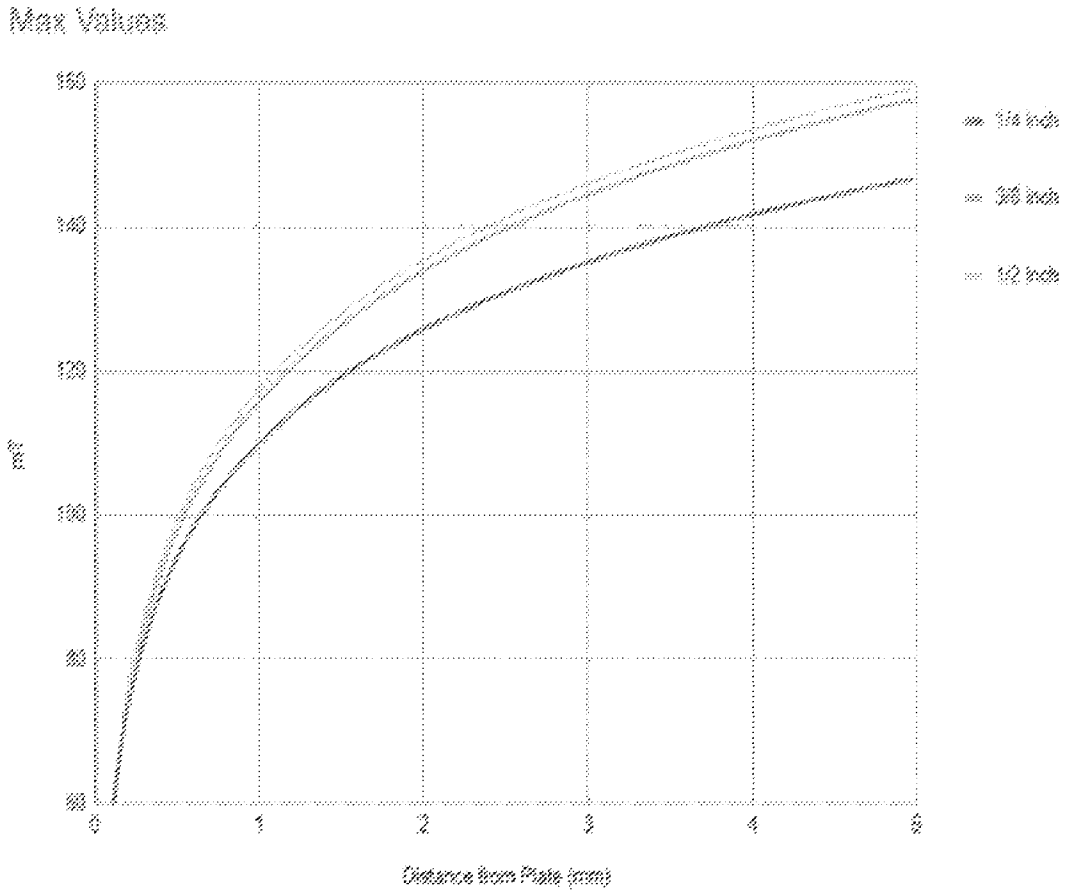
FIG. 15 shows the relationship between magnet flux and the air gap, in accordance with some embodiments of the disclosure.

Now referring to FIG. 15, as previously described, movement and operation of the robotic system 10 requires a first, anchored adhesion engine 50 to act as a pivot point and a second, unanchored adhesion engine 50 to rotate about that pivot point to clean/groom the surface of the ship's hull during movement. To avoid the system 10 falling off of the surface of the ship's hull, verifying the adequacy of the adhesion force between the anchored adhesion engine 50 and the surface of the ship's hull is crucial to avoid the system 10 pealing or slipping off of the surface of the ship's hull.

Figure 16:
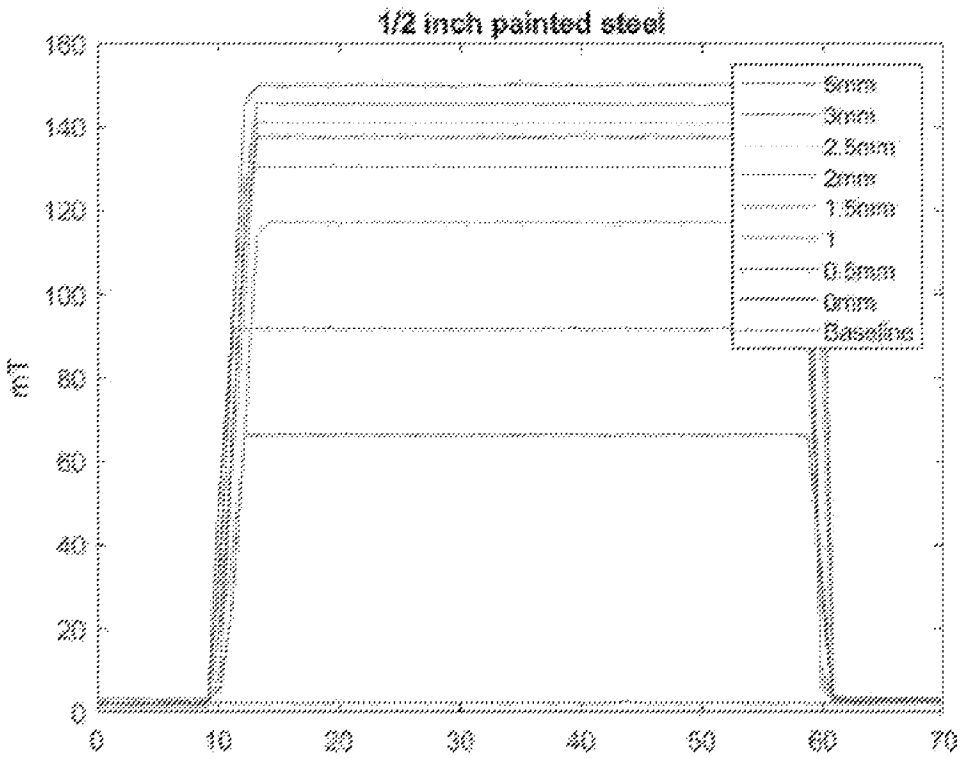
FIG. 16 shows the relationship between magnet flux and time for various air gap distances (in mm) between a 150 lb. switchable magnet and a ½-in. thick steel plate, in accordance with some embodiments of the disclosure.

A first method for verifying the adequacy of the adhesion force between the anchored adhesion engine 50 and the surface of the ship's hull involves using one or more magnetometers disposed radially about the adhesion devices (e.g., magnets) 26 and adapted to measure the magnetic flux adjacent to and about the adhesion devices (e.g., magnets) 26. FIG. 15 shows the relationship between magnetic flux and the distance from the surface of a ¼-in., ⅜-in. and ½-in thick steel plate, i.e., the air gap, and the relationship between magnetic flux and varying thicknesses, while FIG. 16 shows the relationship between magnetic flux and time for various air gap distances (in mm) between a 150 lb. switchable magnet and a ½-in. thick steel plate.

Alternatively, motor current feedback may be monitored to verify the adequacy of the adhesion force between the anchored adhesion engine 50 and the surface of the ship's hull. Indeed, when the upper magnet of the anchored adhesion engine 50 rotates with respect to the (e.g., lower) static magnet, there is a known torque that is required to turn the upper magnet. For example, if both the upper and lower magnets are in free space the torque required to rotate the magnet into position will be a maximum. However, as the magnet approaches a ferrous surface (i.e., the surface of the ship's hull) the torque is reduced as the magnetic flux is directed into the ferrous surface rather than fighting the magnets. Thus, data on the relationship of current to torque required to move the magnets as a function of the air gap between the magnets and the surface of the ship's hull can be used to correlate the adequacy of the adhesion force. Advantageously, the thickness of the ship's hull may be assessed based on the current required to actuate the magnets.

Machine Learning Embodiments

Figure 17:
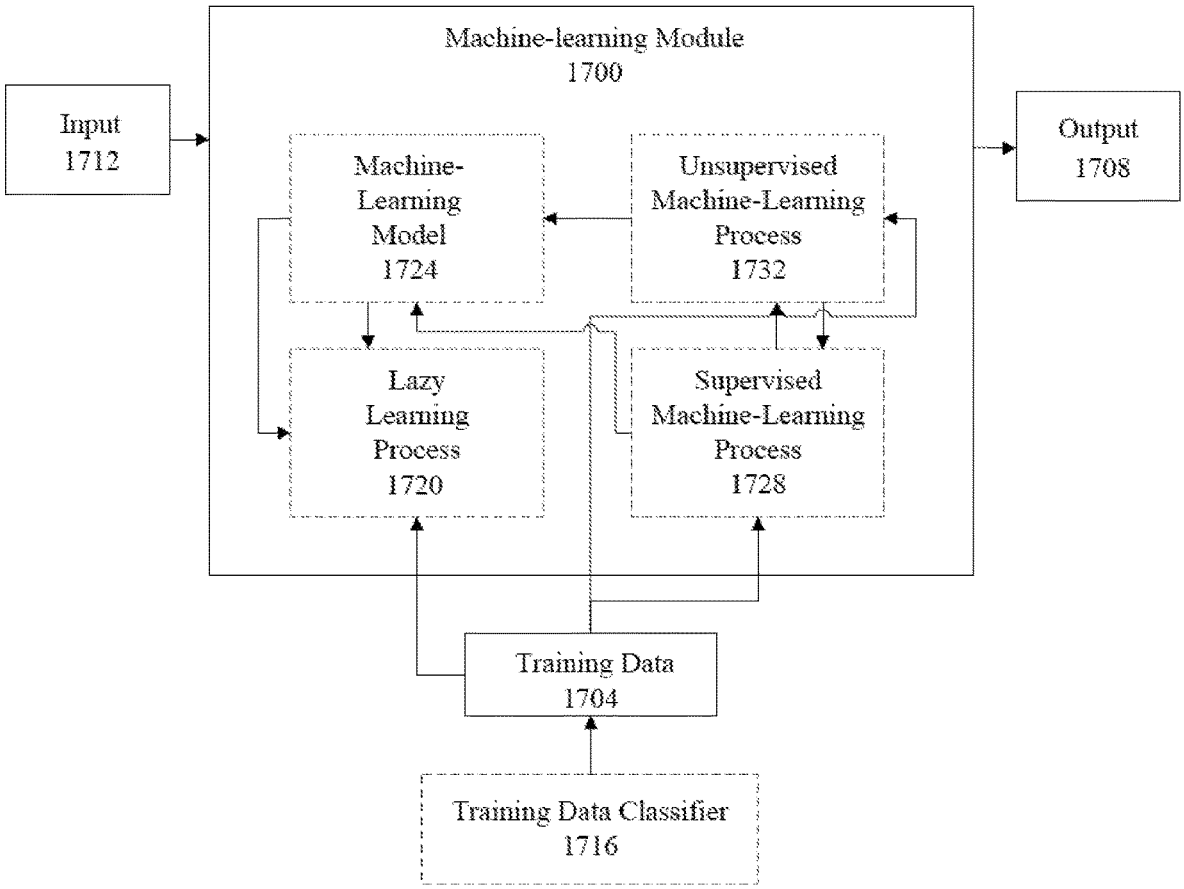
FIG. 17 shows a block diagram of a machine learning module that may be used with the present system.

FIG. 17 illustrates an exemplary embodiment of a machine-learning module 1700 that may perform one or more machine-learning processes as described herein. Machine-learning module 1700 may be configured to perform various determinations, calculations, processes and the like as described in this disclosure using a machine-learning process. A "machine learning process," as used in this disclosure, is a process that automatedly uses training data to generate an algorithm that calculates outputs given data as inputs. A machine learning process contrasts to a nonmachine learning software program where the commands to be executed are determined in advance by a user and written in a programming language.

Still referring to FIG. 17, machine learning module 1700 may utilize training data 1704. "Training data," as used herein, refers to data containing correlations that a machine-learning process may use to model relationships between two or more categories of data elements. For instance, and without limitation, training data 1704 may include a plurality of data entries, each entry representing a set of data elements that were recorded, received, and/or generated together. Training data 1704 may include data elements that may be correlated by shared existence in a given data entry, by proximity in a given data entry, or the like. Multiple data entries in training data 1704 may demonstrate one or more trends in correlations between categories of data elements. For instance, and without limitation, a higher value of a first data element belonging to a first category of data element may tend to correlate to a higher value of a second data element belonging to a second category of data element, indicating a possible proportional or other mathematical relationship linking values belonging to the two categories.

Multiple categories of data elements may be related in training data 1704 according to various correlations. Correlations may indicate causative and/or predictive links between categories of data elements, which may be modeled as relationships such as mathematical relationships by machine-learning processes as described in further detail below. Training data 1704 may be formatted and/or organized by categories of data elements. Training data 1704 may, for instance, be organized by associating data elements with one or more descriptors corresponding to categories of data elements. As a non-limiting example, training data 1704 may include data entered in standardized forms by one or more individuals, such that entry of a given data element in a given field in a form may be mapped to one or more descriptors of categories. Elements in training data 1704 may be linked to descriptors of categories by tags, tokens, or other data elements. Training data 1704 may be provided in fixed-length formats, formats linking positions of data to categories such as comma-separated value (CSV) formats and/or self-describing formats. Self-describing formats may include, without limitation, extensible markup language (XML), JavaScript Object Notation (JSON), or the like, which may enable processes or devices to detect categories of data.

With continued reference to refer to FIG. 17, training data 1704 may include one or more elements that are not categorized. Uncategorized data of training data 1704 may include data that may not be formatted or containing descriptors for some elements of data. In some embodiments, machine-learning algorithms and/or other processes may sort training data 1704 according to one or more categorizations. Machine-learning algorithms may sort training data 1704 using, for instance, natural language processing algorithms, tokenization, detection of correlated values in raw data and the like. In some embodiments, categories of training data 1704 may be generated using correlation and/or other processing algorithms. As a non-limiting example, in a body of text, phrases making up a number "n" of compound words, such as nouns modified by other nouns, may be identified according to a statistically significant prevalence of n-grams containing such words in a particular order. For instance, an n-gram may be categorized as an element of language such as a "word" to be tracked similarly to single words, which may generate a new category as a result of statistical analysis. In a data entry including some textual data, a person's name may be identified by reference to a list, dictionary, or other compendium of terms, permitting ad-hoc categorization by machine-learning algorithms, and/or automated association of data in the data entry with descriptors or into a given format. The ability to categorize data entries automatedly may enable the same training data 1704 to be made applicable for two or more distinct machine-learning algorithms as described in further detail below. Training data 1704 used by machine-learning module 1700 may correlate any input data as described in this disclosure to any output data as described in this disclosure, without limitation.

Further referring to FIG. 17, training data 1704 may be filtered, sorted, and/or selected using one or more supervised and/or unsupervised machine-learning processes and/or models as described in further detail below. In some embodiments, training data 1704 may be classified using training data classifier 1716. Training data classifier 1716 may include a classifier. A "classifier" as used in this disclosure is a machine-learning model that sorts inputs into one or more categories. Training data classifier 1716 may utilize a mathematical model, neural net, or program generated by a machine learning algorithm. A machine learning algorithm of training data classifier 1716 may include a classification algorithm. A "classification algorithm" as used in this disclosure is one or more computer processes that generate a classifier from training data. A classification algorithm may sort inputs into categories and/or bins of data. A classification algorithm may output categories of data and/or labels associated with the data. A classifier may be configured to output a datum that labels or otherwise identifies a set of data that may be clustered together. Machine-learning module 1700 may generate a classifier, such as training data classifier 1716 using a classification algorithm. Classification may be performed using, without limitation, linear classifiers such as without limitation logistic regression and/or naive Bayes classifiers, nearest neighbor classifiers such ask-nearest neighbors classifiers, support vector machines, least squares support vector machines, fisher's linear discriminant, quadratic classifiers, decision trees, boosted trees, random forest classifiers, learning vector quantization, and/or neural network-based classifiers. As a non-limiting example, training data classifier 1716 may classify elements of sensor data to adhesion levels.

Still referring to FIG. 17, machine-learning module 1700 may be configured to perform a lazy-learning process 1720. Lazy-learning process 1720 may include a "lazy loading" or "call-when-needed" process and/or protocol. A "lazy-learning process" may include a process in which machine learning is performed upon receipt of an input to be converted to an output, by combining the input and training set to derive the algorithm to be used to produce the output on demand. For instance, an initial set of simulations may be performed to cover an initial heuristic and/or "first guess" at an output and/or relationship. As a non-limiting example, an initial heuristic may include a ranking of associations between inputs and elements of training data 1704. Heuristic may include selecting some number of highest-ranking associations and/or training data 1704 elements. Lazy learning may implement any suitable lazy learning algorithm, including without limitation a K-nearest neighbors algorithm, a lazy naive Bayes algorithm, or the like; persons skilled in the art, upon reviewing the entirety of this disclosure, will be aware of various lazy-learning algorithms that may be applied to generate outputs as described in this disclosure, including without limitation lazy learning applications of machine learning algorithms as described in further detail below.

Still referring to FIG. 17, machine-learning processes as described in this disclosure may be used to generate machine-learning models 1724. A "machine-learning model" as used in this disclosure is a mathematical and/or algorithmic representation of a relationship between inputs and outputs, as generated using any machine-learning process including without limitation any process as described above, and stored in memory. For instance, an input may be sent to machine-learning model 1724, which once created, may generate an output as a function of a relationship that was derived. For instance, and without limitation, a linear regression model, generated using a linear regression algorithm, may compute a linear combination of input data using coefficients derived during machine-learning processes to calculate an output. As a further non-limiting example, machine-learning model 1724 may be generated by creating an artificial neural network, such as a convolutional neural network comprising an input layer of nodes, one or more intermediate layers, and an output layer of nodes. Connections between nodes may be created via the process of "training" the network, in which elements from a training data 1704 set are applied to the input nodes, a suitable training algorithm (such as Levenberg-Marquardt, conjugate gradient, simulated annealing, or other algorithms) is then used to adjust the connections and weights between nodes in adjacent layers of the neural network to produce the desired values at the output nodes. This process is sometimes referred to as deep learning.

Still referring to FIG. 17, machine-learning algorithms may include supervised machine-learning process 1728. A "supervised machine learning process" as used in this disclosure is one or more algorithms that receive labelled input data and generate outputs according to the labelled input data. For instance, supervised machine learning process 1728 may include sensor data as described above as input, traversal paths as outputs, and a scoring function representing a desired form of relationship to be detected between inputs and outputs. A scoring function may maximize a probability that a given input and/or combination of elements inputs is associated with a given output to minimize a probability that a given input is not associated with a given output. A scoring function may be expressed as a risk function representing an "expected loss" of an algorithm relating inputs to outputs, where loss is computed as an error function representing a degree to which a prediction generated by the relation is incorrect when compared to a given input-output pair provided in training data 1704. Persons skilled in the art, upon reviewing the entirety of this disclosure, will be aware of various possible variations of at least a supervised machine-learning process 1728 that may be used to determine relation between inputs and outputs. Supervised machine-learning processes may include classification algorithms as defined above.

Further referring to FIG. 17, machine learning processes may include unsupervised machine-learning processes 1732. An "unsupervised machine-learning process" as used in this disclosure is a process that calculates relationships in one or more datasets without labelled training data. Unsupervised machine-learning process 1732 may be free to discover any structure, relationship, and/or correlation provided in training data 1704. Unsupervised machine-learning process 1732 may not require a response variable. Unsupervised machine-learning process 1732 may calculate patterns, inferences, correlations, and the like between two or more variables of training data 1704. In some embodiments, unsupervised machine-learning process 1732 may determine a degree of correlation between two or more elements of training data 1704.

Still referring to FIG. 17, machine-learning module 1700 may be designed and configured to create a machine-learning model 1724 using techniques for development of linear regression models. Linear regression models may include ordinary least squares regression, which aims to minimize the square of the difference between predicted outcomes and actual outcomes according to an appropriate norm for measuring such a difference (e.g. a vector-space distance norm); coefficients of the resulting linear equation may be modified to improve minimization. Linear regression models may include ridge regression methods, where the function to be minimized includes the least-squares function plus term multiplying the square of each coefficient by a scalar amount to penalize large coefficients. Linear regression models may include least absolute shrinkage and selection operator (LASSO) models, in which ridge regression is combined with multiplying the least-squares term by a factor of I divided by double the number of samples. Linear regression models may include a multi-task lasso model wherein the norm applied in the least-squares term of the lasso model is the Frobenius norm amounting to the square root of the sum of squares of all terms. Linear regression models may include the elastic net model, a multi-task elastic net model, a least angle regression model, a LARS lasso model, an orthogonal matching pursuit model, a Bayesian regression model, a logistic regression model, a stochastic gradient descent model, a perceptron model, a passive aggressive algorithm, a robustness regression model, a Huber regression model, or any other suitable model that may occur to persons skilled in the art upon reviewing the entirety of this disclosure. Linear regression models may be generalized in an embodiment to polynomial regression models, whereby a polynomial equation (e.g. a quadratic, cubic or higher-order equation) providing a best predicted output/actual output fit is sought; similar methods to those described above may be applied to minimize error functions, as will be apparent to persons skilled in the art upon reviewing the entirety of this disclosure.

Continuing to refer to FIG. 17, machine-learning algorithms may include, without limitation, linear discriminant analysis. Machine-learning algorithm may include quadratic discriminate analysis. Machine-learning algorithms may include kernel ridge regression. Machine-learning algorithms may include support vector machines, including without limitation support vector classification-based regression processes. Machine-learning algorithms may include stochastic gradient descent algorithms, including classification and regression algorithms based on stochastic gradient descent. Machine-learning algorithms may include nearest neighbors algorithms. Machine-learning algorithms may include various forms of latent space regularization such as variational regularization. Machine-learning algorithms may include Gaussian processes such as Gaussian Process Regression. Machine-learning algorithms may include cross-decomposition algorithms, including partial least squares and/or canonical correlation analysis. Machine-learning algorithms may include naive Bayes methods. Machine-learning algorithms may include algorithms based on decision trees, such as decision tree classification or regression algorithms. Machine-learning algorithms may include ensemble methods such as bagging meta-estimator, forest of randomized tress, AdaBoost, gradient tree boosting, and/or voting classifier methods.

Machine-learning algorithms may include neural net algorithms, including convolutional neural net processes.

The foregoing description, for purposes of explanation, used specific nomenclature to provide a thorough understanding of the invention. However, it will be apparent to one skilled in the art that specific details are not required in order to practice the invention. Thus, the foregoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to best explain the principles of the invention and its practical applications, they thereby enable others skilled in the art to best utilize the invention and various embodiments with various modifications as are suited to the particular use contemplated. The disclosed embodiments are contemplated in various combinations and permutations. It is intended that the following claims and their equivalents define the scope of the invention.

The invention claimed is:

1. A submersible robot system for inspecting and/or grooming objects in a marine environment, the system comprising:

a housing;

a sensor configured to generate sensor data;

a processor disposed in the housing and in communication with the sensor;

a plurality of adhesion engines disposed within the housing, each adhesion engine in communication with the processor and comprising:

a plurality of magnetic adhesion devices structured and arranged to secure the system to the object, each of the magnetic adhesion devices being mechanically switchable between a zero magnetic field and full magnetic field strength;

a magnetic switch motor for mechanically switching on and off the magnetic adhesion devices;

at least one grooming element; and a body rotation motor for moving the grooming element across a surface of the object;

wherein the processor is configured to command the magnetic switch motor of each adhesion engine based on the sensor data, wherein a commanding of the magnetic switch motor of each adhesion engine causes the system to traverse the surface of the object.

2. The submersible robot system of claim 1, wherein the processor is configured to adjust a magnetic field of at least a magnetic adhesion device of the plurality of magnetic adhesion devices to adjust an adhesion of the system to the surface of the object.

3. The submersible robot system of claim 1, wherein the magnetic switch is configured to alternatively switch on and off at least two magnetic adhesion devices.

4. The submersible robot system of claim 3, wherein the at least two magnetic adhesion devices include a first pivot and a second pivot, wherein the system traverses the surface of the object through alternatively switching on and off the first pivot and the second pivot.

5. The submersible robot system of claim 1, wherein the processor is configured to generate a temporal mapping of the object based on the sensor data.

6. The submersible robot system of claim 1, wherein the processor is further configured to adjust a programmed path based on the sensor data.

7. The submersible robot system of claim 1, further comprising an illumination device configured to illuminate an environment of the system.

8. The submersible robot system of claim 1, wherein the sensor is an imaging device.

9. The submersible robot system of claim 1, wherein the object is a ship.

10. The submersible robot system of claim 1, wherein the sensor is configured to detect a magnetic field and the processor is configured to determine a weld line of the object based on data generated by the sensor.

11. A method for inspecting and/or grooming an object in a marine environment, the method comprising:

providing a submersible robot system for grooming the object, the robot system comprising:

a housing;

a sensor configured to generate sensor data;

a processor disposed in the housing and in communication with the sensor;

a plurality of adhesion engines disposed within the housing, each adhesion engine in communication with the processor and comprising:

a plurality of magnetic adhesion devices structured and arranged to secure the system to the object, each of the magnetic adhesion devices being mechanically switchable between a zero magnetic field and full magnetic field strength;

a magnetic switch motor for mechanically switching on and off the magnetic adhesion devices;

at least one grooming element; and a body rotation motor for moving the grooming element across a surface of the object; and navigating the submersible robot system across the object to groom the object.

12. The method of claim 11, wherein navigating comprises alternatively switching on and off at least two magnetic adhesion devices.

13. The method of claim 11, further comprising cleaning, by the at least one grooming element, the surface of the object.

14. The method of claim 11, further comprising generating, by the processor, a temporal mapping of the object based on the sensor data.

15. The method of claim 11, further comprising adjusting, by the processor, a programmed path based on the sensor data.

16. The method of claim 11, wherein the submersible robot system further comprises an illumination device configured to illuminate an environment of the system.

17. The method of claim 11, wherein the sensor is an imaging device.

18. The method of claim 11, wherein the object is a ship.

19. The method of claim 11, wherein navigating further comprises:

determining a level of cleanliness of the surface of the object; and adjusting a movement of the at least one grooming element based on the determined level of cleanliness of the surface of the object.

20. The method of claim 11, wherein navigating further comprises:

detecting, by the sensor, an eddy current; and determining, by the processor, a weld line of the object based on the Eddy current.

* * * * *